US011268743B2

(12) United States Patent
Watanabe et al.

(10) Patent No.: US 11,268,743 B2
(45) Date of Patent: Mar. 8, 2022

(54) AIR-CONDITIONING APPARATUS HAVING HEATING-DEFROSTING OPERATION MODE

(71) Applicant: Mitsubishi Electric Corporation, Chiyoda-ku (JP)

(72) Inventors: Kazuya Watanabe, Chiyoda-ku (JP); Soshi Ikeda, Chiyoda-ku (JP); Shohei Ishimura, Chiyoda-ku (JP); Hideto Nakao, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 59 days.

(21) Appl. No.: 16/642,085

(22) PCT Filed: Mar. 7, 2018

(86) PCT No.: PCT/JP2018/008814
§ 371 (c)(1),
(2) Date: Feb. 26, 2020

(87) PCT Pub. No.: WO2019/073621
PCT Pub. Date: Apr. 18, 2019

(65) Prior Publication Data

US 2020/0232693 A1 Jul. 23, 2020

(30) Foreign Application Priority Data

Oct. 12, 2017 (JP) ..... JP2017-198583

(51) Int. Cl.
*F25B 47/02* (2006.01)
*F25B 13/00* (2006.01)

(52) U.S. Cl.
CPC ..... *F25B 47/025* (2013.01); *F25B 13/00* (2013.01); *F25B 2313/02532* (2013.01);
(Continued)

(58) Field of Classification Search
CPC ..... F25B 2313/0233; F25B 2313/0253; F25B 2313/02532; F25B 5/02
See application file for complete search history.

(56) References Cited

U.S. PATENT DOCUMENTS

2002/0043073 A1* 4/2002 Park ..... F25B 41/20 62/231
2013/0312447 A1* 11/2013 Inaba ..... F24F 11/30 62/324.6

(Continued)

FOREIGN PATENT DOCUMENTS

CN 104011485 A 8/2014
CN 104813123 A 7/2015

(Continued)

OTHER PUBLICATIONS

International Search Report dated May 15, 2018 in PCT/JP2018/008814 filed on Mar. 7, 2018, 2 pages.

(Continued)

*Primary Examiner* — Henry T Crenshaw
(74) *Attorney, Agent, or Firm* — Xsensus LLP

(57) ABSTRACT

An air-conditioning apparatus includes a main circuit in which a compressor, a load side heat exchanger, a first pressure reducing device, and a plurality of parallel heat exchangers connected in parallel with each other are connected by pipes, a bypass pipe diverting a portion of refrigerant discharged by the compressor, a flow switching unit connecting a parallel heat exchanger to be defrosted to the bypass pipe, a plurality of flow rate control devices controlling flow rates of refrigerant flowing through the plurality of parallel heat exchangers, and a controller which controls, in the heating-defrosting operation mode or in the heating operation mode after execution of the heating-defrosting operation mode, the flow rate control devices to control, in accordance with a frost state of a parallel heat (Continued)

exchanger functioning as an evaporator among the plurality of parallel heat exchangers, the flow rate of refrigerant flowing through the parallel heat exchanger.

12 Claims, 12 Drawing Sheets

(52) U.S. Cl.
CPC . *F25B 2313/02533* (2013.01); *F25B 2500/19* (2013.01); *F25B 2700/197* (2013.01); *F25B 2700/2106* (2013.01); *F25B 2700/21175* (2013.01)

(56) References Cited

U.S. PATENT DOCUMENTS

| | | | | |
|---|---|---|---|---|
| 2014/0245766 | A1 | 9/2014 | Wakamoto et al. | |
| 2015/0292789 | A1 | 10/2015 | Takenaka et al. | |
| 2015/0308701 | A1 | 10/2015 | Yamashita et al. | |
| 2016/0153697 | A1* | 6/2016 | Hamamoto ..... | F25B 13/00 62/140 |
| 2019/0154321 | A1 | 5/2019 | Takenaka et al. | |

FOREIGN PATENT DOCUMENTS

| | | | | |
|---|---|---|---|---|
| EP | 3 282 208 | A1 | | 2/2018 |
| JP | 55-28459 | A | | 2/1980 |
| JP | 2008-157558 | A | | 7/2008 |
| JP | 2008-157588 | | * | 10/2008 |
| JP | 2008 249236 | | * | 10/2008 |
| JP | 2008-249236 | A | | 10/2008 |
| JP | 2009-281698 | A | | 12/2009 |
| JP | 2012 063033 | | * | 2/2012 |
| JP | 2012-63033 | A | | 3/2012 |
| JP | 2016-211839 | A | | 12/2016 |
| WO | WO 2013/128897 | A1 | | 9/2013 |
| WO | WO 2014/083867 | A1 | | 6/2014 |
| WO | WO 2014/128831 | A1 | | 8/2014 |
| WO | 2017/006596 | A1 | | 1/2017 |

OTHER PUBLICATIONS

Office Action dated Mar. 3, 2021, in corresponding Chinese patent Application No. 201880065316.5, 15 pages.
Extended European Search Report dated Nov. 13, 2020 in European Patent Application No. 18866482.5, 7 pages.

* cited by examiner

FIG. 3

| CONTROL TARGET | COOLING OPERATION | HEATING OPERATION | |
|---|---|---|---|
| | | NORMAL HEATING OPERATION | HEATING-DEFROSTING OPERATION |
| COOLING-HEATING SWITCHING DEVICE 2 | OFF | ON | ON |
| FIRST PRESSURE REDUCING DEVICES 4b, 4c | DEGREE OF SUPERHEAT OF REFRIGERANT AT INDOOR-UNIT OUTLET | DEGREE OF SUBCOOLING OF REFRIGERANT AT INDOOR-UNIT OUTLET | DEGREE OF SUBCOOLING OF REFRIGERANT AT INDOOR-UNIT OUTLET |
| FIRST OPEN-CLOSE DEVICES 8-1 TO 8-4 | ON | ON | ·CONNECT TO TARGET TO BE DEFROSTED: OFF<br>·CONNECT TO EVAPORATOR: ON |
| SECOND OPEN-CLOSE DEVICES 9-1 TO 9-4 | OFF | OFF | ·CONNECT TO TARGET TO BE DEFROSTED: ON<br>·CONNECT TO EVAPORATOR: OFF |
| THIRD PRESSURE REDUCING DEVICE 10 | FULLY CLOSED | FULLY CLOSED | FIX OPENING DEGREE |

AIR-CONDITIONING APPARATUS HAVING HEATING-DEFROSTING OPERATION MODE

CROSS-REFERENCE TO RELATED APPLICATIONS

This application is a United States national stage application of International Application No. PCT/JP2018/008814, filed Mar. 7, 2018, which designates the United States, and claims priority to Japan Patent Application No. 2017-198583, filed Oct. 12, 2017, and the entire contents of each of the above applications are hereby incorporated herein by reference in entirety.

TECHNICAL FIELD

The present disclosure relates to an air-conditioning apparatus that performs a heating operation.

BACKGROUND ART

Recently, in terms of global environment protection, more heat pump air-conditioning apparatuses using air as a heat source have been introduced to regions in a cold climate instead of boiler heating devices that perform heating by burning fossil fuel. Heat pump air-conditioning apparatuses can perform heating more efficiently by the amount of heat supplied from air in addition to an electrical input to a compressor.

However, in a heat pump air-conditioning apparatus, an outdoor heat exchanger functioning as an evaporator frosts over when the outside air temperature becomes low, and thus defrosting needs to be performed to melt frost formed on the outdoor heat exchanger. As a defrosting method, there is a method for reversing the refrigeration cycle; however, by using this method, heating of the indoor space is stopped during defrosting and the degree of comfort is reduced.

Thus, as a device that can perform heating even during defrosting, an air-conditioning apparatus has been proposed that performs heating by dividing an outdoor heat exchanger and causing, while defrosting some of the divided outdoor heat exchangers, the other portion of the heat exchanger to operate as an evaporator (for example, see Patent Literature 1 and Patent Literature 2).

In an air-conditioning apparatus disclosed in Patent Literature 1, an outdoor heat exchanger is divided into two parallel heat exchangers, a portion of refrigerant discharged from a compressor is caused to flow into the two parallel heat exchangers alternately, and the two parallel heat exchangers are alternately defrosted. Consequently, heating is continuously performed without reversing the refrigeration cycle.

In an air-conditioning apparatus disclosed in Patent Literature 2, an outdoor heat exchanger is divided into a plurality of parallel heat exchangers, and after a portion of refrigerant discharged from a compressor is caused to flow in order into the plurality of parallel heat exchangers to perform defrosting, the air-conditioning apparatus returns to a heating operation. When returning to the heating operation, this air-conditioning apparatus detects a parallel heat exchanger on which a large amount of frost is formed, defrosts again only the parallel heat exchanger, on which a large amount of frost is formed, and then returns to the heating operation.

CITATION LIST

Patent Literature

Patent Literature 1: International Publication No. 2014/083867

Patent Literature 2: Japanese Unexamined Patent Application Publication No. 2009-281698

SUMMARY OF INVENTION

Technical Problem

In the air-conditioning apparatus disclosed in Patent Literature 1, while one of the two parallel heat exchangers is being defrosted, the frost state of the parallel heat exchanger functioning as an evaporator changes. Accordingly, a state occurs in which the heat exchange performance differs between the parallel heat exchanger on which a large amount of frost is formed and the parallel heat exchanger on which a small amount of frost is formed. When refrigerant is caused to flow through the two parallel heat exchangers having different heat exchange performance at almost the same flow rate, the heat exchangers as a whole cannot be efficiently used, the heating capacity is reduced, and the degree of comfort in the indoor space is reduced.

When the air-conditioning apparatus disclosed in Patent Literature 2 returns to the heating operation from the defrosting operation, variations in the amount of frost formed are reduced by defrosting again the parallel heat exchanger on which a large amount of frost is formed; however, since defrosting is performed two times, it takes a longer time to return to the heating operation. In addition, variations in the amount of frost formed occur also while the defrosting operation is being performed on one or more of the plurality of parallel heat exchangers, and thus substantially the same problem as that of Patent Literature 1 arises, the heating capacity is reduced, and the degree of comfort in the indoor space is reduced.

The present air-conditioning apparatus of the present disclosure has been made to overcome the problems as described above, and provides an air-conditioning apparatus that efficiently performs defrosting without stopping heating and that increases the degree of comfort in the air-conditioned space.

Solution to Problem

An air-conditioning apparatus according to an embodiment of the present disclosure includes a main circuit in which a compressor, a load side heat exchanger, a first pressure reducing device, and a plurality of parallel heat exchangers connected in parallel with each other are connected by pipes and through which refrigerant circulates; a bypass pipe diverting a portion of refrigerant discharged by the compressor; a flow switching unit connecting, from among the plurality of parallel heat exchangers, a parallel heat exchanger to be defrosted to the bypass pipe; a plurality of flow rate control devices connected to the plurality of parallel heat exchangers and controlling flow rates of refrigerant flowing through the plurality of parallel heat exchangers; and a controller being configured to control the flow switching unit and the plurality of flow rate control devices, the air-conditioning apparatus being configured to operate in a heating operation mode for causing the plurality of parallel heat exchangers to function as an evaporator, and a heating-defrosting operation mode for causing one or more of the plurality of parallel heat exchangers to function as a target to be defrosted and for causing an other parallel heat exchanger to function as an evaporator, wherein the controller is configured to control in the heating-defrosting operation mode or in the heating operation mode after execution of the heating-defrosting operation mode, the flow rate control devices to control, in accordance with a frost state of the parallel heat exchanger functioning as an evaporator from among the plurality of parallel heat exchangers, the flow rate of refrigerant flowing through the parallel heat exchanger.

Advantageous Effects of Invention

According to embodiments of the present disclosure, since the flow rate of refrigerant flowing through a parallel heat exchanger functioning as an evaporator is controlled in accordance with the frost state of the parallel heat exchanger, defrosting can be efficiently performed without stopping heating, and the degree of comfort in the air-conditioned space can be increased.

BRIEF DESCRIPTION OF DRAWINGS

FIG. 3 is a diagram illustrating a control state of each of open-close devices, pressure reducing devices, and a flow rate control device illustrated in FIG. 1 in individual operation states of the air-conditioning apparatus, the control state being related to on and off and the opening degree.

DESCRIPTION OF EMBODIMENTS

Figure 1:
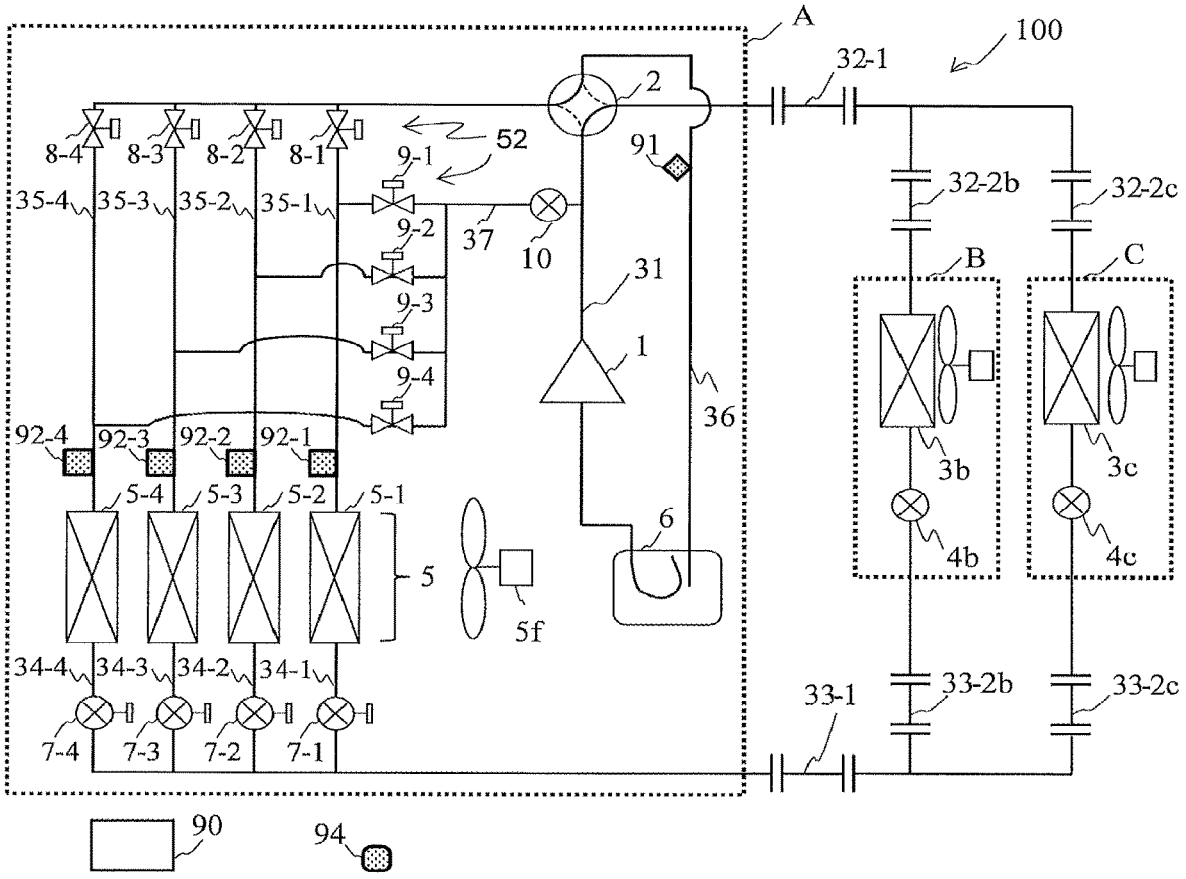
FIG. 1 is a refrigerant circuit diagram illustrating a refrigerant circuit configuration of an air-conditioning apparatus according to Embodiment 1 of the present disclosure.

Embodiments of the present disclosure will be described with reference to the drawings. In the individual drawings, configurations denoted by the same reference numerals are the same or substantially the same, and this applies to all of Embodiments described in the following. In addition, forms of individual structural elements described in Embodiments are mere examples and are not limited to those described in Embodiments.

Embodiment 1

The configuration of an air-conditioning apparatus according to Embodiment 1 will be described. FIG. 1 is a refrigerant circuit diagram illustrating a refrigerant circuit configuration of the air-conditioning apparatus according to Embodiment 1 of the present disclosure. An air-conditioning apparatus 100 includes an outdoor unit A and a plurality of indoor units B and C, which are connected in parallel with each other. The outdoor unit A functions as a heat source device or a heat source side unit that generates heat to be supplied to the indoor units B and C. The indoor units B and C function as a load side unit that uses heat supplied from the outdoor unit A.

The outdoor unit A and the indoor unit B are connected by first extension pipes 32-1 and 32-2*b* and second extension pipes 33-1 and 33-2*b*. The outdoor unit A and the indoor unit C are connected by the first extension pipe 32-1, a first extension pipe 32-2*c*, the second extension pipe 33-1, and a second extension pipe 33-2*c*.

The air-conditioning apparatus 100 is provided with a controller 90, which controls a cooling operation and a heating operation of the indoor units B and C. In addition, the air-conditioning apparatus 100 is provided with an outside air temperature detector 94, which detects the temperature of air around the outdoor unit A.

As refrigerant circulating between the outdoor unit A and the indoor units B and C, a fluorocarbon refrigerant or a HFO refrigerant is used. The fluorocarbon refrigerant is, for example, an HFC based refrigerant R32, R125, or R134*a* or R410A, R407*c*, or R404A that are refrigerant mixtures of these HFC based refrigerants. In addition, the HFO refrigerant is, for example, HFO-1234yf, HFO-1234ze (E), or HFO-1234ze (Z). In addition, as other refrigerants, refrigerants used in vapor compression heat pumps such as $CO_2$ refrigerant, HC refrigerants, ammonia refrigerant, and refrigerants obtained by mixing refrigerants described above an example of which is refrigerant obtained by mixing R32 and HFO-1234yf are used. HC refrigerants include, for example, propane refrigerant and isobutane refrigerant.

Note that, in Embodiment 1, the configuration in which two indoor units, which are the indoor units B and C, are connected to one outdoor unit, which is the outdoor unit A, is described as an example; however, the number of indoor units provided in the air-conditioning apparatus 100 is not limited to two, and may also be one or three or more. In addition, the air-conditioning apparatus 100 may also be provided with two or more outdoor units A. In this case, the two or more outdoor units A may also be connected in parallel. In addition, by providing three extension pipes in parallel to connect the outdoor unit A to the indoor units B and C or by providing on the indoor unit side a refrigerant flow switching device, each of the indoor units B and C may have a refrigerant circuit configuration with which a cooling-heating simultaneous operation can be performed in which both cooling and heating can be selected.

The configuration of a refrigerant circuit in the air-conditioning apparatus 100 illustrated in FIG. 1 will be described. The refrigerant circuit of the air-conditioning apparatus 100 includes a main circuit. In the main circuit, a compressor 1, which compresses and discharges refrigerant, a cooling-heating switching device 2, which switches the direction of refrigerant flow, load side heat exchangers 3*b* and 3*c*, first pressure reducing devices 4*b* and 4*c*, which can be opened and closed, and an outdoor heat exchanger 5 are connected by pipes.

The cooling-heating switching device 2 is connected between a discharge pipe 31 of the compressor 1 and a suction pipe 36. The cooling-heating switching device 2 switches an operation state of the indoor units B and C by switching the direction of refrigerant flow. Connection established by the cooling-heating switching device 2 in a case where the indoor units B and C perform a heating operation is illustrated with a solid line in the cooling-heating switching device 2 of FIG. 1. Connection established by the cooling-heating switching device 2 in a case where the indoor units B and C perform a cooling operation is illustrated with a broken line in the cooling-heating switching device 2 of FIG. 1. The cooling-heating switching device 2 is, for example, a four-way valve.

In the configuration illustrated in FIG. 1, the main circuit is provided with an accumulator 6; however, the main circuit does not have to be necessarily provided with the accumulator 6. In addition, in the configuration illustrated in FIG. 1, the first pressure reducing device 4*b* is provided in the indoor unit B and the first pressure reducing device 4*c* is provided in the indoor unit C; however, the positions of these pressure reducing devices are not limited to those illustrated in FIG. 1. The installation positions of the pressure reducing devices may be not only in the indoor units B and C but also in the outdoor unit A. For example, the pressure reducing devices may be provided between the outdoor heat exchanger 5 and the second extension pipe 33-1 in the outdoor unit A.

Figure 2:
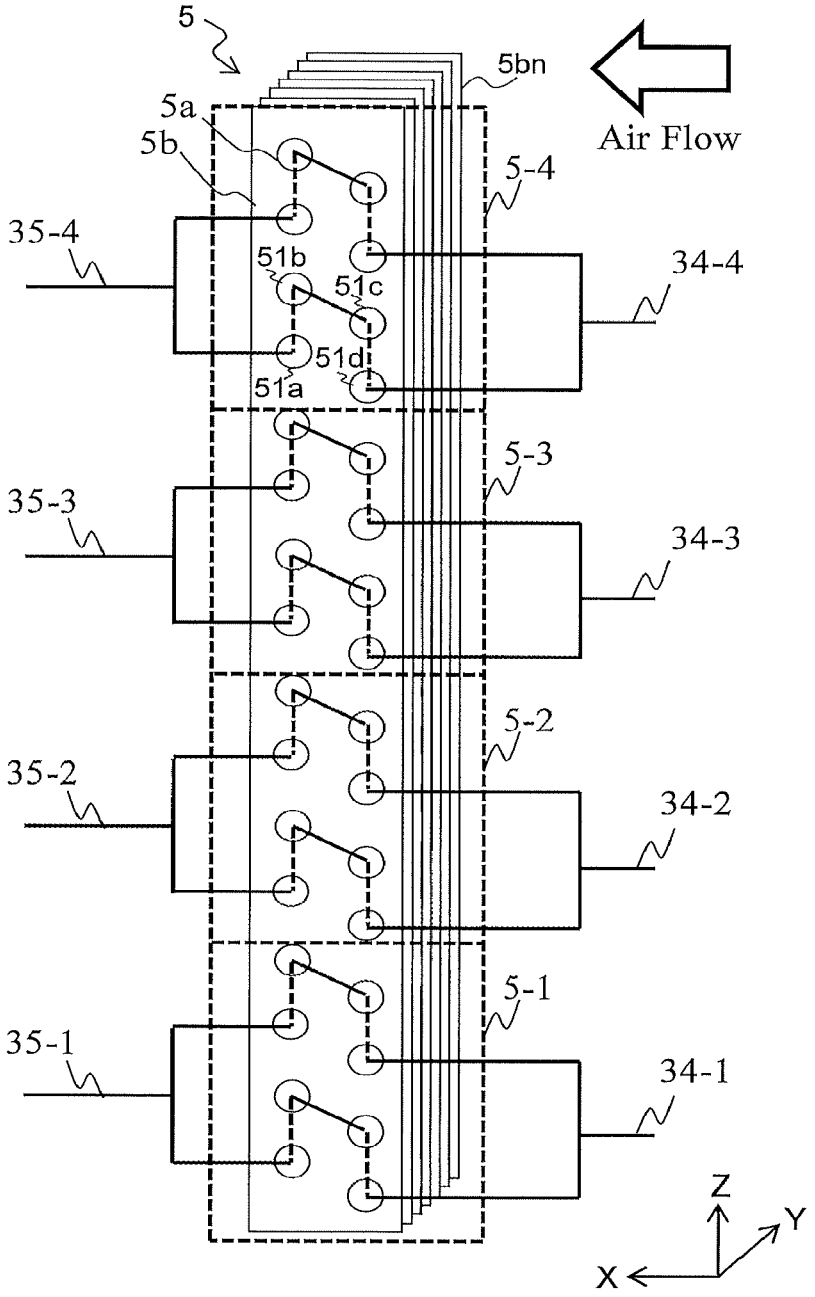
FIG. 2 is a diagram illustrating an example of the configuration of an outdoor heat exchanger of the air-conditioning apparatus according to Embodiment 1 of the present disclosure.

FIG. 2 is a diagram illustrating an example of the configuration of an outdoor heat exchanger of the air-conditioning apparatus according to Embodiment 1 of the present disclosure. As illustrated in FIG. 2, for example, the outdoor heat exchanger 5 is configured by a fin tube heat exchanger including a plurality of heat transfer tubes 5*a* and a plurality of fins 5*b*. The outdoor heat exchanger 5 is divided into a plurality of parallel heat exchangers. In Embodiment 1, as an example of the outdoor heat exchanger 5, a case where the outdoor heat exchanger 5 is divided into four parallel heat exchangers 5-1 to 5-4 will be described. For the description, FIG. 2 illustrates the X axis, the Y axis, and the Z axis, which define directions.

The fins 5*b* illustrated in FIG. 2 have a plate shape parallel to the XZ plane. In the outdoor heat exchanger 5, the plurality of fins 5*b* are arranged so as to be spaced apart from their adjacent fins 5*b* in the direction of the Y-axis arrow, so that air flows easily in an air flow direction (the direction of the X-axis arrow). The heat transfer tubes 5*a* are pipes in and through which refrigerant flows. The plurality of heat transfer tubes 5*a* extend in the direction of the Y-axis arrow to penetrate through the plurality of fins 5*b*. The heat transfer tubes 5*a* are arranged to form a plurality of stages in the direction (the direction of the Z-axis arrow) perpendicular to the air flow direction. In addition, the heat transfer tubes 5*a* are arranged in a plurality of columns in the air flow direction (the direction of the X-axis arrow). In the configuration illustrated in FIG. 2, in each of the parallel heat exchangers 5-1 to 5-4, the plurality of heat transfer tubes 5*a* are arranged in four stages in the direction of the Z-axis arrow and in two columns in the direction of the X-axis arrow.

In the configuration illustrated in FIG. 2, the parallel heat exchangers 5-1 to 5-4 are configured to divide the outdoor heat exchanger 5 in the up-down direction (the direction of the Z-axis arrow) in the housing of the outdoor unit A. The outdoor heat exchanger 5 does not have to be necessarily divided in the up-down direction illustrated in FIG. 2, and may also be divided in the right-left direction (the direction of the Y-axis arrow or the X-axis direction).

The configuration in which the outdoor heat exchanger 5 is divided in the up-down direction has the advantage of facilitating pipe connection but also has the disadvantage that water generated in the upper parallel heat exchangers flows down to the lower parallel heat exchangers. In this case, when the upper parallel heat exchangers perform defrosting, if the lower parallel heat exchangers function as an evaporator, water generated by defrosting performed by the upper parallel heat exchangers may be frozen at the lower parallel heat exchangers, and heat exchange may be hindered. In contrast, in the configuration in which the outdoor heat exchanger 5 is divided in the right-left direction, pipe connection becomes complicated because a refrigerant inlet of each of the parallel heat exchangers 5-1 to 5-4 needs to be provided at both of the left and right ends of the outdoor unit A or a refrigerant inlet and a refrigerant outlet need to be provided on the same ZY plane; however, the adhesion of water generated by defrosting to the other parallel heat exchangers can be prevented.

The arrangement of the heat transfer tubes 5*a* will be described while focusing on the lower heat transfer tube 5*a* of the parallel heat exchanger 5-4 among the parallel heat exchangers 5-1 to 5-4 illustrated in FIG. 2. For the description, as illustrated in FIG. 2, four opening ports provided in the fin 5*b* closest to the origin in the direction of the Y-axis arrow are denoted by 51*a* to 51*d*. In addition, in the direction of the Y-axis arrow, the fin farthest from the fin 5*b* closest to the origin is denoted by 5*bn*.

Among two branch pipes of a second connection pipe 35-4, one of the branch pipes is connected to the opening port 51*a*. The heat transfer tube 5*a* connected to the branch pipe at the opening port 51*a* extends parallel to the Y axis from the opening port 51*a* to the fin 5*bn*. The heat transfer tube 5*a* is folded back on itself at the fin 5*bn* and then extends parallel to the Y axis from the fin 5*bn* to the opening port 51*b* of the fin 5*b*. Next, the heat transfer tube 5*a* extends from the opening port 51*b* to the opening port 51*c* at the fin 5*b*, and extends parallel to the Y axis from the opening port 51*c* to the fin 5*bn*. Furthermore, the heat transfer tube 5*a* is folded back on itself at the fin 5*bn* and then extends parallel to the Y axis from the fin 5*bn* to the opening port 51*d* of the fin 5*b*. Among two branch pipes of a first connection pipe 34-4, the heat transfer tube 5*a* is connected to one of the branch pipes at the opening port 51*d*.

Note that, in the configuration illustrated in FIG. 2, the plurality of fins 5*b* are not divided into four in the Z axis direction with respect to the parallel heat exchangers 5-1 to 5-4; however, the fins 5*b* may also be divided into a number corresponding to the number of parallel heat exchangers. In addition, at least one of the plurality of fins 5*b* of the parallel heat exchangers 5-1 to 5-4 may be provided with a mechanism for reducing heat leakage. As the mechanism for reducing heat leakage, for example, a configuration is conceivable in which the fin is provided with a notch or a slit. In addition, a heat transfer tube through which high temperature refrigerant flows may be provided between the parallel heat exchangers 5-1 to 5-4.

By dividing the plurality of fins 5*b* to correspond to the number of parallel heat exchangers or by providing the fins 5*b* with a mechanism for reducing heat leakage or a heat transfer tube through which high temperature refrigerant flows, heat leakage from the parallel heat exchanger to be defrosted to the parallel heat exchanger serving as an evaporator can be suppressed. Accordingly, it can be prevented that defrosting becomes difficult at the division boundaries due to heat leakage. Note that the number of divisions for the parallel heat exchangers in the outdoor heat exchanger 5 is not limited to four and may be any number greater than or equal to two.

As illustrated in FIG. 1, the outdoor unit A is provided with an outdoor fan 5*f* for supplying outdoor air to the parallel heat exchangers 5-1 to 5-4. The number of outdoor fans 5*f* may be one as illustrated in FIG. 1, or the outdoor fan 5*f* may also be installed in each of the parallel heat exchangers 5-1 to 5-4.

First connection pipes 34-1 to 34-4 connect between the parallel heat exchangers 5-1 to 5-4 and the first pressure reducing devices 4*b* and 4*c* within a part of the refrigerant circuit being connection of the parallel heat exchangers 5-1 to 5-4, first flow control devices 7-1 to 7-4 and the first pressure reducing devices 4*b* and 4*c*. The first connection pipes 34-1 to 34-4 are connected in parallel with each other to main pipes extending from the first pressure reducing devices 4*b* and 4*c*. The first connection pipes 34-1 to 34-4 are respectively provided with first flow control devices 7-1 to 7-4, which control the flow rate of circulating refrigerant. The first flow control devices 7-1 to 7-4 change their opening degrees in accordance with a control signal input from the controller 90. The first flow control devices 7-1 to 7-4 are, for example, an electronic control expansion valve.

Second connection pipes 35-1 to 35-4 connect between the parallel heat exchangers 5-1 to 5-4 and the cooling-heating switching device 2 within a part of the refrigerant circuit being connection of the parallel heat exchangers 5-1 to 5-4, second connection pipes 35-1 to 35-4, the cooling-heating switching device 2 and the compressor 1. The second connection pipes 35-1 to 35-4 are respectively provided with first open-close devices 8-1 to 8-4. The parallel heat exchangers 5-1 to 5-4 are connected to the cooling-heating switching device 2 with the second connection pipes 35-1 to 35-4 and the first open-close devices 8-1 to 8-4 therebetween.

In addition, the refrigerant circuit is provided with a bypass pipe 37, which diverts a portion of high-temperature high-pressure refrigerant discharged from the compressor 1 and supplies the diverted refrigerant to the parallel heat exchangers 5-1 to 5-4. One end of the bypass pipe 37 is connected to the discharge pipe 31, and the other end thereof splits up into four and connected to the second connection pipes 35-1 to 35-4. In the configuration illustrated in FIG. 1, the one end of the bypass pipe 37 is connected to the discharge pipe 31; however, the one end does not have to be necessarily connected to the discharge pipe 31. It is sufficient that the bypass pipe 37 can bypass high-temperature high-pressure gas refrigerant discharged from the compressor 1 during the heating operation, so the one end of the bypass pipe 37 may also be connected between the cooling-heating switching device 2 and the first extension pipe 32-1.

The one end of the bypass pipe 37 connected to the discharge pipe 31 is provided with a third pressure reducing device 10. On the side where the bypass pipe 37 splits up to realize connection to the second connection pipes 35-1 to 35-4, second open-close devices 9-1 to 9-4 are provided. The first open-close devices 8-1 to 8-4 and the second open-close devices 9-1 to 9-4 function as a flow switching unit 52, which connects, among the parallel heat exchangers 5-1 to 5-4, a parallel heat exchanger to be defrosted to the bypass pipe 37.

Note that, in the configuration illustrated in FIG. 1, each of the first open-close devices 8-1 to 8-4 and the second open-close devices 9-1 to 9-4 are a two-way valve but not limited to a two-way valve. It is sufficient that the first open-close devices 8-1 to 8-4 and the second open-close devices 9-1 to 9-4 can open and close flow paths, and a single valve may be caused to have the function of opening and closing a plurality of flow paths by using a three-way valve or a four-way valve as one or more of these open-close devices. In this case, the number of open-close devices can be reduced. In addition, if necessary defrosting capacity, that is, the flow rate of refrigerant for defrosting is predetermined, the third pressure reducing device 10 may be a capillary tube. In addition, the second open-close devices 9-1 to 9-4 may be caused to have a function equivalent to that of the third pressure reducing device 10 by using a pressure reducing device that can be fully closed. In this case, the third pressure reducing device 10 does not need to be provided.

The second connection pipes 35-1 to 35-4 are provided with temperature detectors 92-1 to 92-4 for detecting refrigerant temperature. The suction pipe 36 is provided with a first pressure detector 91 for detecting the pressure of refrigerant. The temperature detectors 92-1 to 92-4 and the first pressure detector 91 function as a detection device for detecting a value for determining a frost state of each parallel heat exchanger functioning as an evaporator among the parallel heat exchangers 5-1 to 5-4.

In the configuration illustrated in FIG. 1, the first pressure detector 91 is provided at the suction pipe 36; however, the first pressure detector 91 does not have to be installed necessarily at the suction pipe 36. It is sufficient that the first pressure detector 91 can detect the pressure of refrigerant at a parallel heat exchanger that functions as an evaporator among the parallel heat exchangers 5-1 to 5-4, and the first pressure detector 91 may be installed between the first open-close devices 8-1 to 8-4 and the cooling-heating switching device 2. Furthermore, the first pressure detector 91 may also be installed between each of the first flow control devices 7-1 to 7-4 and a corresponding one of the first open-close devices 8-1 to 8-4. Instead of the pressure detector, a temperature detector that can detect refrigerant temperature may be provided at a pipe portion where refrigerant enters a two-phase gas-liquid state. A value detected by the temperature detector is treated as the saturation temperature of refrigerant, and the pressure of refrigerant may be converted from the saturation temperature of refrigerant.

The controller 90 is, for example, a microcomputer. The controller 90 is connected to the temperature detectors 92-1 to 92-4 and the first pressure detector 91 by a signal line, and receives a measurement value from each detector. The controller 90 is connected to each device that is a control target by a signal line, and outputs a control signal through the signal line. Specifically, in accordance with an operation mode set in the air-conditioning apparatus 100, the controller 90 controls flow path switching performed by the cooling-heating switching device 2, the opening degrees of the first pressure reducing devices 4*b* and 4*c*, and an operating frequency of the compressor 1. In addition, the controller 90 controls opening-closing of the first open-close devices 8-1 to 8-4 and the second open-close devices 9-1 to 9-4 and the opening degrees of the first flow control devices 7-1 to 7-4 and the third pressure reducing device 10.

Next, the operation of the air-conditioning apparatus 100 in individual operation states will be described. The air-conditioning apparatus 100 has two kinds of operation mode, which are a cooling operation and a heating operation. The heating operation has a heating operation mode and a heating-defrosting operation mode. The heating operation mode corresponds to an operation in which all the parallel heat exchangers 5-1 to 5-4 constituting the outdoor heat exchanger 5 function as a normal evaporator.

The heating-defrosting operation mode corresponds to an operation in which one or more of the parallel heat exchangers 5-1 to 5-4 are treated as targets to be defrosted and the other parallel heat exchangers are caused to function as an evaporator. In the heating-defrosting operation mode, while one or more of the parallel heat exchangers 5-1 to 5-4 are being defrosted, the other parallel heat exchangers can continue the heating operation.

In addition, in the heating-defrosting operation mode, the air-conditioning apparatus 100 may defrost the parallel heat exchangers 5-1 to 5-4 in order, one at a time. For example, while performing the heating operation by causing the parallel heat exchangers 5-1 to 5-3 to function as an evaporator, the air-conditioning apparatus 100 defrosts the other parallel heat exchanger 5-4. After defrosting of the parallel heat exchanger 5-4 is completed, the air-conditioning apparatus 100 subsequently performs the heating operation by causing the parallel heat exchangers 5-1, 5-2, and 5-4 to operate as an evaporator, and defrosts the other parallel heat exchanger 5-3. In this manner, while continuing the heating operation, the air-conditioning apparatus 100 can defrost all the parallel heat exchangers 5-1 to 5-4 by sequentially changing the parallel heat exchangers to be defrosted. The heating-defrosting operation is also called a continuous heating operation since the heating operation is not stopped by sequentially defrosting the parallel heat exchangers 5-1 to 5-4. About the following heating operations, the operation in the heating operation mode will be called a heating normal operation to be distinguished from a case where the heating operation is performed while one or more of the parallel heat exchangers are being defrosted.

FIG. 3 is a diagram illustrating a control state of each of the open-close devices, the pressure reducing devices, and the flow rate control device illustrated in FIG. 1 in each operation state of the air-conditioning apparatus, the control state being related to on and off and the opening degree. The controller 90 performs control illustrated in FIG. 3. The heating-defrosting operation illustrated in FIG. 3 corresponds to a case where one or more of the parallel heat exchangers 5-1 to 5-4 are treated as targets to be defrosted and the other parallel heat exchangers function as an evaporator.

In a case where the cooling-heating switching device 2 is to be controlled, the on state of FIG. 3 indicates that a flow path is set as illustrated with a solid line in the four-way valve of FIG. 1, and the off state of FIG. 3 indicates that a flow path is set as illustrated with a broken line in the four-way valve of FIG. 1. In a case where the first open-close devices 8-1 to 8-4 and 9-1 to 9-4 are to be controlled, the on state of FIG. 3 indicates that the open-close devices are open and refrigerant circulates, and the off state of FIG. 3 indicates that the open-close devices are closed and refrigerant does not circulate. Regarding the first pressure reducing device 4*b*, as illustrated in FIG. 3, the controller 90 controls the opening degree in accordance with the degree of superheat of refrigerant of the indoor unit B in the case of the cooling operation, and controls the opening degree in accordance with the degree of subcooling of refrigerant of the indoor unit B in the case of the heating operation. The first pressure reducing device 4*c* will be controlled substantially in the same manner.

[Cooling Operation]

Figure 4:
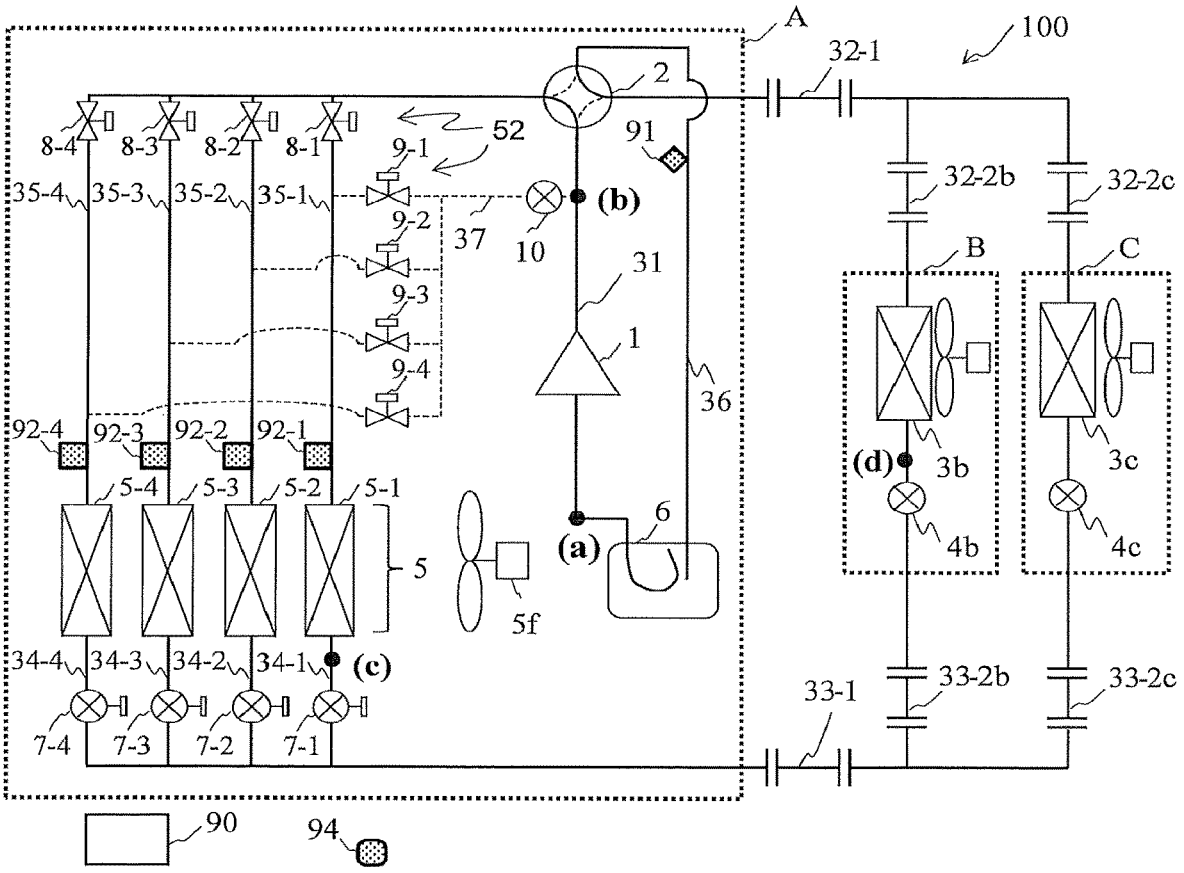
FIG. 4 is a diagram illustrating the flow of refrigerant at the time of a cooling operation performed by the air-conditioning apparatus according to Embodiment 1 of the present disclosure.
Figure 5:
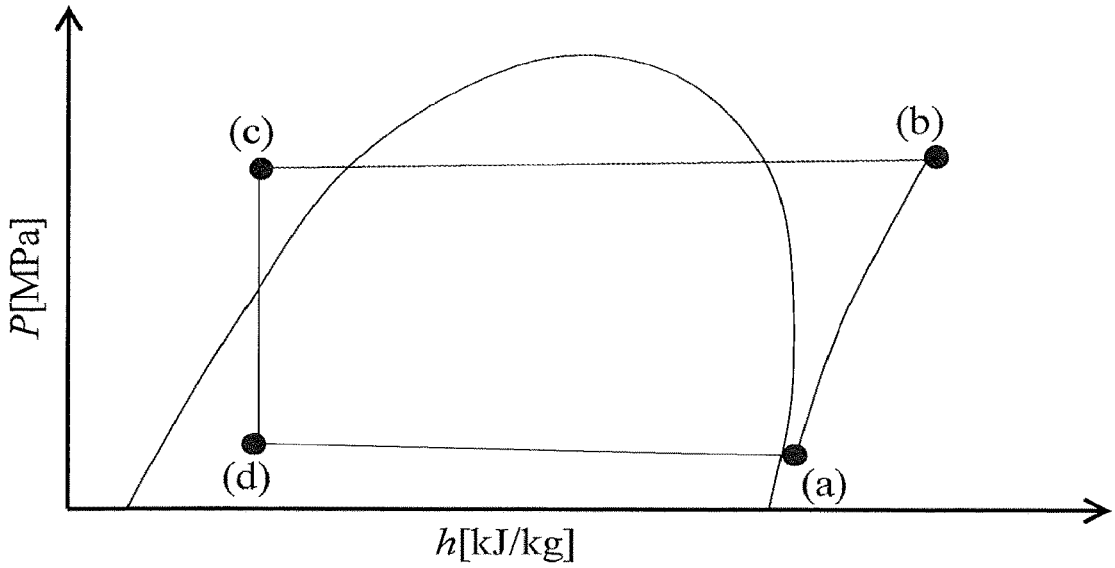
FIG. 5 is a P-h diagram at the time of the cooling operation performed by the air-conditioning apparatus according to Embodiment 1 of the present disclosure.

FIG. 4 is a diagram illustrating the flow of refrigerant at the time of the cooling operation performed by the air-conditioning apparatus according to Embodiment 1 of the present disclosure. In FIG. 4, a pipe portion where refrigerant flows at the time of the cooling operation is illustrated with a solid line and a pipe portion where refrigerant does not flow is illustrated with a broken line. FIG. 5 is a P-h diagram at the time of the cooling operation performed by the air-conditioning apparatus according to Embodiment 1 of the present disclosure. Points (a) to (d) of FIG. 5 illustrate states of refrigerant at portions denoted by points (a) to (d) illustrated in FIG. 4.

When the compressor 1 starts operating, low-temperature low-pressure gas refrigerant is compressed by the compressor 1, and high-temperature high-pressure gas refrigerant is discharged from the compressor 1. In this refrigerant compression process of the compressor 1, compared with a case where adiabatic compression is performed along an isentropic line, compression is performed such that heating is performed by an amount corresponding to the adiabatic efficiency of the compressor 1, and the refrigerant compression process is represented by the line from point (a) to point (b) of FIG. 5. The high-temperature high-pressure gas refrigerant discharged from the compressor 1 passes through the cooling-heating switching device 2 and is then divided among the four of the first open-close devices 8-1 to 8-4. The flows of the refrigerant that have individually passed through the first open-close devices 8-1 to 8-4 flow into the corresponding parallel heat exchangers 5-1 to 5-4 via the corresponding second connection pipes 35-1 to 35-4.

The refrigerant that has flowed into each of the parallel heat exchangers 5-1 to 5-4 is cooled while heating outside air and becomes middle-temperature high-pressure liquid refrigerant. When pressure loss is taken into consideration, the changes in the refrigerant at the parallel heat exchangers 5-1 to 5-4 are represented by the straight line from point (b)

to point (c) of FIG. 5, which is slightly inclined and close to horizontal. Note that in a case where, for example, the operation capacity of the indoor units B and C is small, the controller 90 may close one or more of the first open-close devices 8-1 to 8-4 and prevent refrigerant from flowing through any of the parallel heat exchangers 5-1 to 5-4. In this case, the heat transfer area of the outdoor heat exchanger 5 becomes small accordingly, and a stable refrigeration cycle operation can be performed.

The flows of the middle-temperature high-pressure liquid refrigerant flowing out from the parallel heat exchangers 5-1 to 5-4 flow into the first connection pipes 34-1 to 34-4, pass through the first flow control devices 7-1 to 7-4, which are in a fully open state, and then merge. The resulting flow of refrigerant passes through the second extension pipe 33-1, and is then divided among and flows into the second extension pipes 33-2*b* and 33-2*c*. The refrigerant flowing through the second extension pipe 33-2*b* flows into the first pressure reducing device 4*b*, and the refrigerant flowing through the second extension pipe 33-2*c* flows into the first pressure reducing device 4*c*. At each of the first pressure reducing devices 4*b* and 4*c*, the refrigerant is expanded, the pressure thereof is reduced, and the refrigerant expands and enters a low-temperature low-pressure two-phase gas-liquid state. The changes in the refrigerant at the first pressure reducing devices 4*b* and 4*c* occur under constant enthalpy. The changes in the refrigerant in this case are represented by the vertical line from point (c) to point (d) of FIG. 5.

The refrigerant that has flowed out from the first pressure reducing device 4*b* and that is in the low-temperature low-pressure two-phase gas-liquid state flows into the load side heat exchanger 3*b*. The refrigerant that has flowed out from the first pressure reducing device 4*c* and that is in the low-temperature low-pressure two-phase gas-liquid state flows into the load side heat exchanger 3*c*. The refrigerant flowing into each of the load side heat exchangers 3*b* and 3*c* is heated while cooling indoor air, and becomes low-temperature low-pressure gas refrigerant.

The controller 90 controls the opening degrees of the first pressure reducing devices 4*b* and 4*c* such that, for example, the degree of superheat (superheat) of the low-temperature low-pressure gas refrigerant is of the order of 2 degrees K to 5 degrees K. When pressure loss is taken into consideration, the changes in the refrigerant at the load side heat exchangers 3*b* and 3*c* are represented by the straight line from point (d) to point (a) of FIG. 5, which is slightly inclined and close to horizontal.

The low-temperature low-pressure gas refrigerant that has flowed out from the load side heat exchanger 3*b* and passed through the first extension pipe 32-2*b* and the low-temperature low-pressure gas refrigerant that has flowed out from the load side heat exchanger 3*c* and passed through the first extension pipe 32-2*c* merge and flow into the first extension pipe 32-1. The refrigerant that has passed through the first extension pipe 32-1 flows into the compressor 1 via the cooling-heating switching device 2 and the accumulator 6, and is compressed again.

[Heating Normal Operation]

Figure 6:
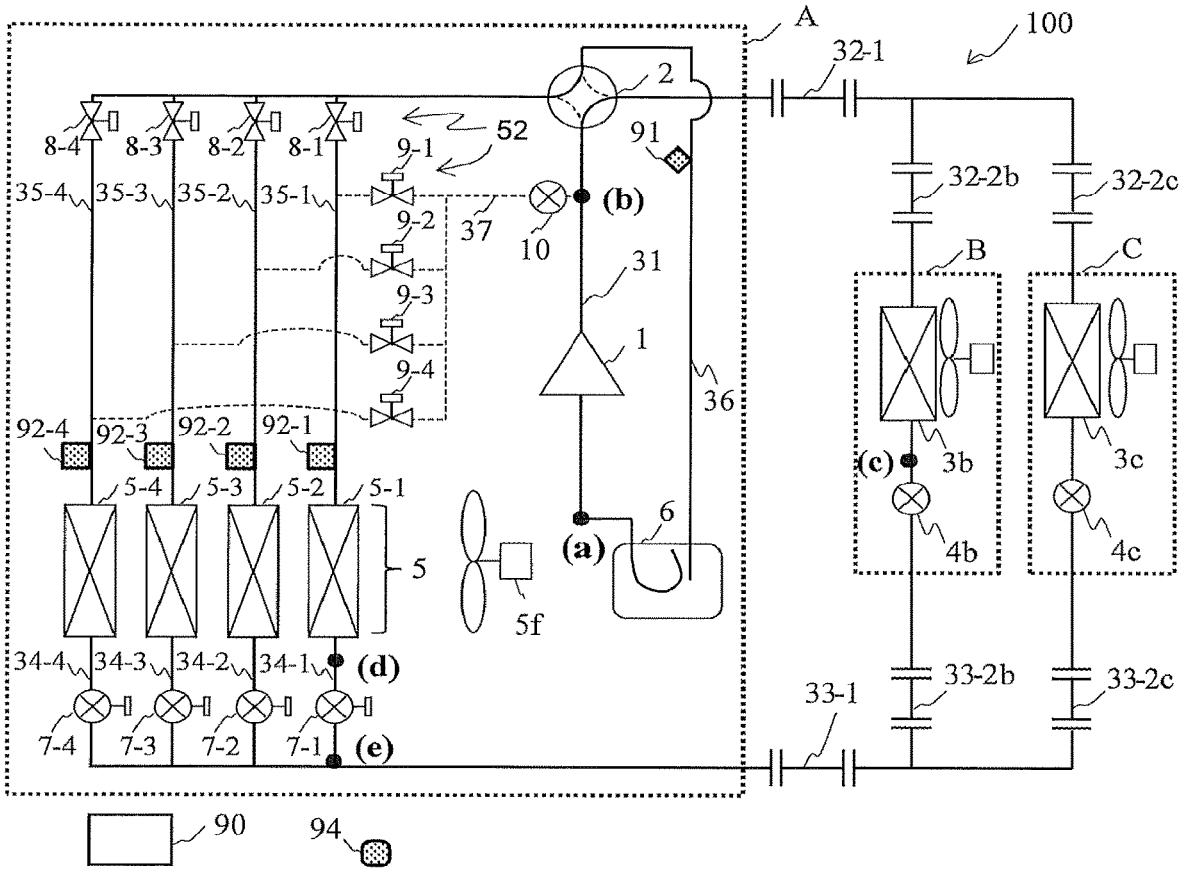
FIG. 6 is a diagram illustrating the flow of refrigerant at the time of a heating normal operation performed by the air-conditioning apparatus according to Embodiment 1 of the present disclosure.
Figure 7:
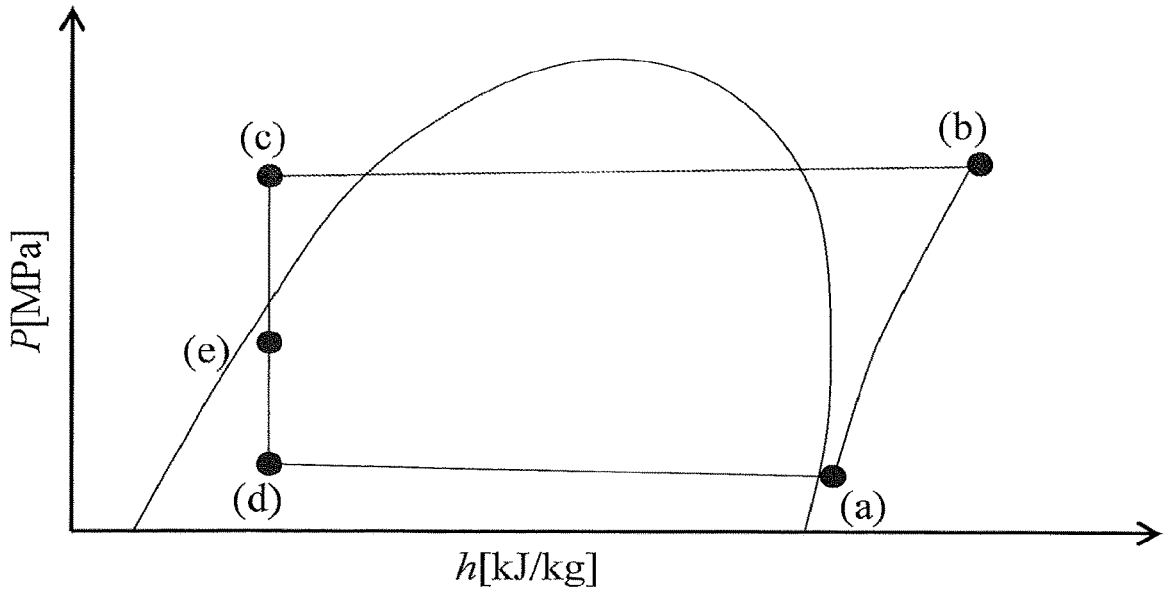
FIG. 7 is a P-h diagram at the time of the heating normal operation performed by the air-conditioning apparatus according to Embodiment 1 of the present disclosure.

FIG. 6 is a diagram illustrating the flow of refrigerant at the time of the heating normal operation performed by the air-conditioning apparatus according to Embodiment 1 of the present disclosure. In FIG. 6, a pipe portion where refrigerant flows at the time of the heating normal operation is illustrated with a solid line and a pipe portion where refrigerant does not flow is illustrated with a broken line. FIG. 7 is a P-h diagram at the time of the heating normal operation performed by the air-conditioning apparatus according to Embodiment 1 of the present disclosure. Points (a) to (e) of FIG. 7 illustrate states of refrigerant at portions denoted by points (a) to (e) illustrated in FIG. 6.

When the compressor 1 starts operating, low-temperature low-pressure gas refrigerant is compressed by the compressor 1, and high-temperature high-pressure gas refrigerant is discharged from the compressor 1. In this refrigerant compression process of the compressor 1, compared with a case where adiabatic compression is performed along an isentropic line, compression is performed such that heating is performed by an amount corresponding to the adiabatic efficiency of the compressor 1, and the refrigerant compression process is represented by the line from point (a) to point (b) of FIG. 7. The high-temperature high-pressure gas refrigerant discharged from the compressor 1 passes through the cooling-heating switching device 2 and then flows out from the outdoor unit A. The high-temperature high-pressure gas refrigerant that has flowed out from the outdoor unit A passes through the first extension pipe 32-1, and is then divided among and flows into the first extension pipes 32-2*b* and 32-2*c*.

The gas refrigerant that has flowed through the first extension pipe 32-2*b* flows into the load side heat exchanger 3*b* of the indoor unit B. The gas refrigerant that has flowed through the first extension pipe 32-2*c* flows into the load side heat exchanger 3*c* of the indoor unit C. The refrigerant flowing into each of the load side heat exchangers 3*b* and 3*c* is cooled while heating indoor air, and becomes middle-temperature high-pressure liquid refrigerant. The load side heat exchangers 3*b* and 3*c* function as a condenser. When pressure loss is taken into consideration, the changes in the refrigerant at the load side heat exchangers 3*b* and 3*c* are represented by the straight line from point (b) to point (c) of FIG. 7, which is slightly inclined and close to horizontal.

The middle-temperature high-pressure liquid refrigerant that has flowed out from the load side heat exchanger 3*b* flows into the first pressure reducing device 4*b*, and the middle-temperature high-pressure liquid refrigerant that has flowed out from the load side heat exchanger 3*c* flows into the first pressure reducing device 4*c*. At each of the first pressure reducing devices 4*b* and 4*c*, the refrigerant is expanded, the pressure thereof is reduced, and the refrigerant expands and enters a low-temperature low-pressure two-phase gas-liquid state. The changes in the refrigerant at the first pressure reducing devices 4*b* and 4*c* occur under constant enthalpy. The changes in the refrigerant in this case are represented by the vertical line from point (c) to point (e) of FIG. 7. The first pressure reducing devices 4*b* and 4*c* are controlled such that, for example, the degree of subcooling (subcooling) of the middle-temperature high-pressure liquid refrigerant is of the order of 5 degrees K to 20 degrees K.

The refrigerant that has flowed out from the first pressure reducing devices 4*b* and 4*c* and that is in a middle-pressure two-phase gas-liquid state returns to the outdoor unit A via the second extension pipes 33-2*b*, 33-2*c*, and 33-1. The refrigerant that has returned to the outdoor unit A flows into the first connection pipes 34-1 to 34-4. The refrigerant that has flowed into the first connection pipes 34-1 to 34-4 is expanded by the first flow control devices 7-1 to 7-4 and expands, the pressure thereof is reduced, and the refrigerant enters a low-temperature low-pressure two-phase gas-liquid state. The changes in the refrigerant at the first flow control devices 7-1 to 7-4 occur under constant enthalpy. The changes in the refrigerant in this case are represented by the line from point (e) to point (d) of FIG. 7. The first flow control devices 7-1 to 7-4 are controlled to be fixed at a predetermined opening degree, for example, in a fully open state or are controlled such that the saturation temperature of the refrigerant at middle pressure in, for example, the second extension pipe 33-1 is of the order of 0 degrees C. to 20 degrees C.

The refrigerant that has flowed out from the first flow control devices 7-1 to 7-4 flows into the parallel heat exchangers 5-1 to 5-4, is heated while cooling outside air, and becomes low-temperature low-pressure gas refrigerant. When pressure loss is taken into consideration, the changes in the refrigerant at the parallel heat exchangers 5-1 to 5-4 are represented by the straight line from point (d) to point (a) of FIG. 7, which is slightly inclined and close to horizontal. The flows of the low-temperature low-pressure gas refrigerant that has flowed out from the parallel heat exchangers 5-1 to 5-4 flow into the second connection pipes 35-1 to 35-4, pass through the first open-close devices 8-1 to 8-4, and then merge. The resulting flow of the refrigerant passes through the cooling-heating switching device 2 and the accumulator 6, flows into the compressor 1, and is compressed.

[Heating-Defrosting Operation (Continuous Heating Operation)]

The heating-defrosting operation is performed in a case where the outdoor heat exchanger 5 becomes frosted over during the heating normal operation. The controller 90 determines the presence or absence of frost formed on the outdoor heat exchanger 5, and determines whether the heating-defrosting operation needs to be performed. The presence or absence of frost formed is determined, for example, on the basis of the saturation temperature of the refrigerant converted from the suction pressure of the compressor 1. In a case where the saturation temperature of the refrigerant becomes substantially lower than a set outside air temperature and smaller than a threshold, the controller 90 determines that frost is formed on the outdoor heat exchanger 5 that needs to be defrosted. As another example, in a case where the temperature difference between the outside air temperature and the evaporating temperature becomes greater than or equal to a preset value and where at least a predetermined time has elapsed in the state, the controller 90 determines that frost is formed on the outdoor heat exchanger 5 that needs to be defrosted. The presence or absence of frost does not have to be determined necessarily by using these methods and may also be determined by using other methods. When determining that frost is formed on the outdoor heat exchanger 5, the controller 90 determines that the conditions for starting the heating-defrosting operation are met.

In Embodiment 1, a case where one of the parallel heat exchangers 5-1 to 5-4 is selected to be defrosted and is defrosted and heating is continued by causing the other three parallel heat exchangers to function as an evaporator is not the only case where the heating-defrosting operation is performed. The heating-defrosting operation may be performed in a case where two of the parallel heat exchangers 5-1 to 5-4 are selected as targets to be defrosted and the other two parallel heat exchangers are caused to function as an evaporator. In addition, the heating-defrosting operation may also be performed in a case where three of the parallel heat exchangers 5-1 to 5-4 are selected to be defrosted and the other parallel heat exchanger is caused to function as an evaporator.

In these operations, only switching is @performed on the open-close states of the first open-close devices 8-1 to 8-4 and the second open-close devices 9-1 to 9-4 and the control states of the first flow control devices 7-1 to 7-4 every time defrosting-target switching is performed on the parallel heat exchangers. Specifically, switching is performed at the devices connected to the parallel heat exchanger or exchangers to be defrosted and at the devices connected to the parallel heat exchanger or exchangers functioning as an evaporator such that high-temperature high-pressure gas refrigerant flows into the parallel heat exchanger or exchangers to be defrosted, and the rest of the operations does not change. Thus, in the following, an operation performed in a case where one parallel heat exchanger is selected to be defrosted will be described. Specifically, a case where the parallel heat exchanger 5-4 is to be defrosted and the heating operation is performed by causing the parallel heat exchangers 5-1 to 5-3 to function as an evaporator will be described. This similarly applies to a description about the heating-defrosting operation, which is to be described in the following.

Figure 8:
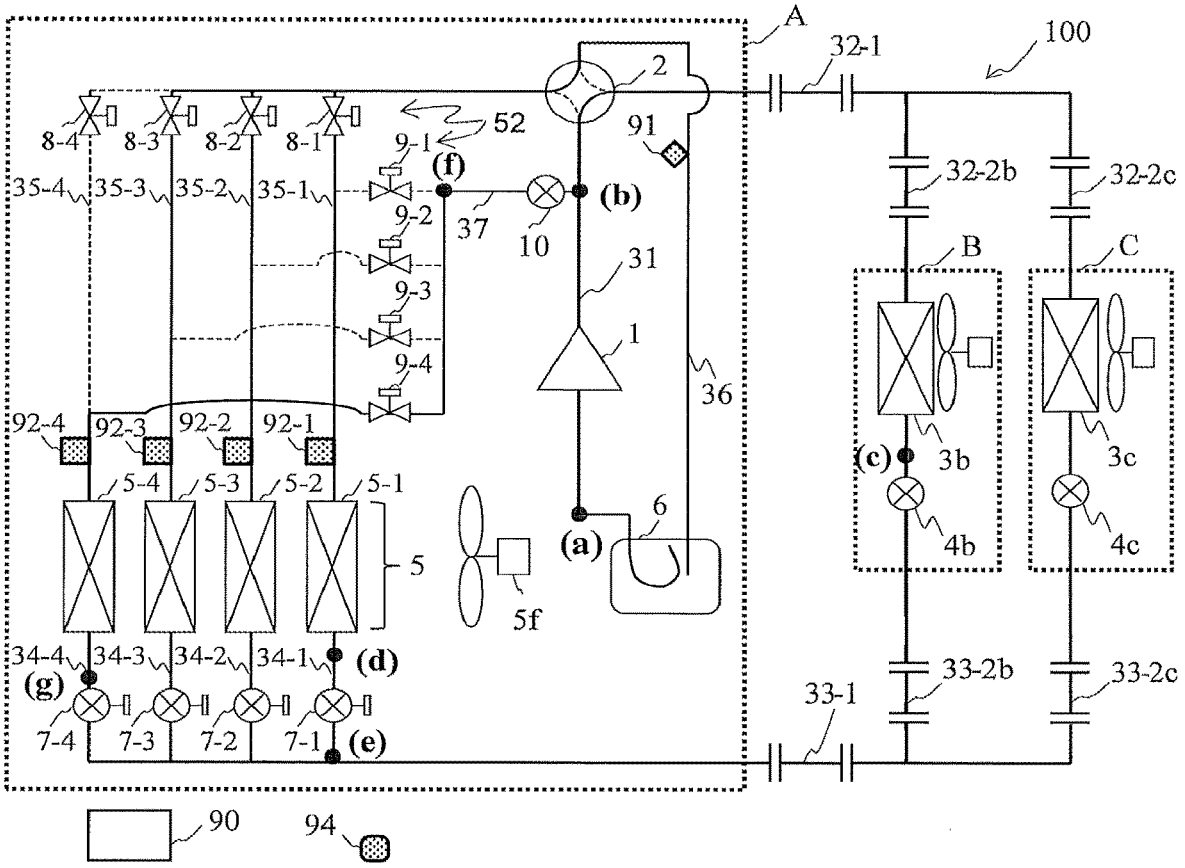
FIG. 8 is a diagram illustrating the flow of refrigerant at the time of a heating-defrosting operation performed by the air-conditioning apparatus according to Embodiment 1 of the present disclosure.
Figure 9:
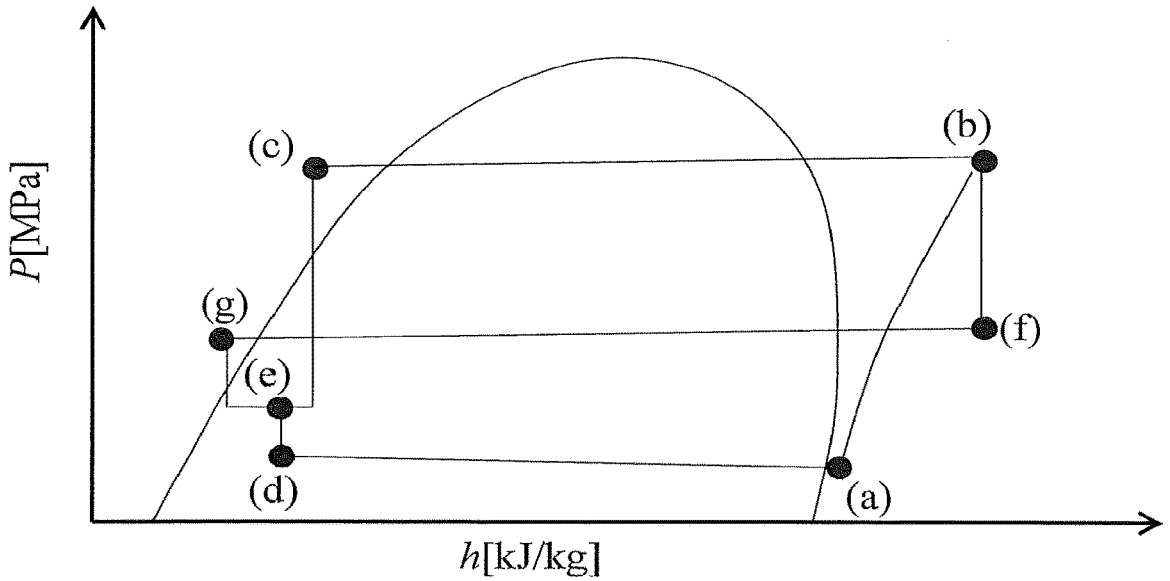
FIG. 9 is a P-h diagram at the time of the heating-defrosting operation performed by the air-conditioning apparatus according to Embodiment 1 of the present disclosure.

FIG. 8 is a diagram illustrating the flow of refrigerant at the time of the heating-defrosting operation performed by the air-conditioning apparatus according to Embodiment 1 of the present disclosure. FIG. 8 illustrates a case where the parallel heat exchanger 5-4 is to be defrosted among the parallel heat exchangers 5-1 to 5-4. In FIG. 8, a pipe portion where refrigerant flows at the time of the heating-defrosting operation is illustrated with a solid line and a pipe portion where refrigerant does not flow is illustrated with a broken line. FIG. 9 is a P-h diagram at the time of the heating-defrosting operation performed by the air-conditioning apparatus according to Embodiment 1 of the present disclosure. Points (a) to (g) of FIG. 9 illustrate states of refrigerant at portions denoted by points (a) to (g) illustrated in FIG. 8.

In a case where, while performing the heating normal operation, the controller 90 determines that defrosting to clear the frost state is necessary, the controller 90 closes the first open-close device 8-4, corresponding to the parallel heat exchanger 5-4, which is to be defrosted. Subsequently, the controller 90 opens the second open-close device 9-4, and opens the third pressure reducing device 10 to achieve a set opening degree. In addition, the controller 90 maintains the first open-close devices 8-1 to 8-3, corresponding to the parallel heat exchangers 5-1 to 5-3, which function as an evaporator, in the open state, and maintains the second open-close devices 9-1 to 9-3 in the closed state. As a result, a defrost circuit is formed in which refrigerant flow paths are connected in the order of the compressor 1, the third pressure reducing device 10, the second open-close device 9-4, the parallel heat exchanger 5-4, and the first flow control device 7-4, and the heating-defrosting operation is started.

When the air-conditioning apparatus 100 starts the heating-defrosting operation, a portion of the high-temperature high-pressure gas refrigerant discharged from the compressor 1 flows into the bypass pipe 37 and the pressure thereof is reduced to middle pressure by the third pressure reducing device 10. The change in the refrigerant in this case is represented by the line from point (b) to point (f) illustrated in FIG. 9. The refrigerant the pressure of which is reduced to middle pressure indicated by point (f) of FIG. 9 flows through the second open-close device 9-4 and flows into the parallel heat exchanger 5-4. The refrigerant that has flowed into the parallel heat exchanger 5-4 is cooled by exchanging heat with frost formed on the parallel heat exchanger 5-4. In this manner, the frost formed on the parallel heat exchanger 5-4 can be melted by causing the high-temperature high-pressure gas refrigerant discharged from the compressor 1 to flow into the parallel heat exchanger 5-4. The change in the refrigerant in this case is represented by the change from point (f) to point (g) in FIG. 9.

The refrigerant used to defrost the parallel heat exchanger 5-4 flows out from the parallel heat exchanger 5-4 and then flows through the first flow control device 7-4, and the flow of the refrigerant merges with that of refrigerant in the main circuit. The resulting flow of the refrigerant in the main circuit flows through the first flow control devices 7-1 to 7-3, flows into the parallel heat exchangers 5-1 to 5-3, which function as an evaporator, and evaporates.

Here, an example of the operation of the first flow control devices 7-1 to 7-4 and the third pressure reducing device 10 during the heating-defrosting operation will be described. During the heating-defrosting operation, the controller 90 controls the opening degree of the first flow control device 7-4, which is connected to the parallel heat exchanger 5-4, which is to be defrosted, such that the saturation temperature converted from the pressure of the parallel heat exchanger 5-4, which is to be defrosted, is of the order of 0 degrees C. to 10 degrees C. In this case, the first flow control device 7-4 functions as a second pressure reducing device that reduces the pressure of the refrigerant such that the saturation temperature of the refrigerant at the parallel heat exchanger 5-4 falls within a set range.

In a case where the saturation temperature converted from the pressure of the refrigerant of the parallel heat exchanger 5-4, which is to be defrosted, is less than or equal to 0 degrees C., the saturation temperature is lower than the melting temperature (0 degrees C.) of frost, and thus the refrigerant does not condense and defrosting is performed using only sensible heat having a small quantity of heat. In this case, the flow rate of refrigerant flowing into the parallel heat exchanger 5-4 needs to be increased to ensure the heating capacity, the flow rate of refrigerant to be used for heating is decreased, and consequently the heat addition capacity decreases and the degree of comfort decreases in an indoor space that is to be air-conditioned.

In contrast, in a case where the pressure of the refrigerant of the parallel heat exchanger 5-4, which is to be defrosted, is high, the temperature difference between the melting temperature (0 degrees C.) of frost and the saturation temperature of the refrigerant is large, the refrigerant that has flowed into the parallel heat exchanger 5-4 immediately liquifies, and thus the amount of liquid refrigerant present inside the parallel heat exchanger 5-4 increases. In this case, the flow rate of refrigerant to be used for heating becomes insufficient, and consequently the heating capacity decreases and the degree of comfort decreases in the indoor space.

From the description above, by causing the saturation temperature converted from the pressure of the refrigerant of the parallel heat exchanger 5-4, which is to be defrosted, to be greater than or equal to 0 degrees C. (for example, on the order of 0 degrees C. to 10 degrees C.), refrigerant can be sufficiently supplied for heating while condensation latent heat having a large amount of heat is being used for defrosting. As a result, the heating capacity is ensured and the degree of comfort in the indoor space can be increased. Note that, in a system having a large amount of refrigerant, in a case where the amount of refrigerant necessary for heating is sufficiently present even when the amount of refrigerant of the parallel heat exchanger 5-4, which is to be defrosted, increases, the saturation temperature of refrigerant of the parallel heat exchanger 5-4, which is to be defrosted, may be higher than 10 degrees C.

In addition, the controller 90 may also control, on the basis of the order in which defrosting is executed, the opening degrees of the first flow control devices 7-1 to 7-3, which are connected to the parallel heat exchangers 5-1 to 5-3, which function as an evaporator, such that refrigerant flows at a higher flow rate in the parallel heat exchanger that is defrosted later in the order of defrosting.

Figure 10:
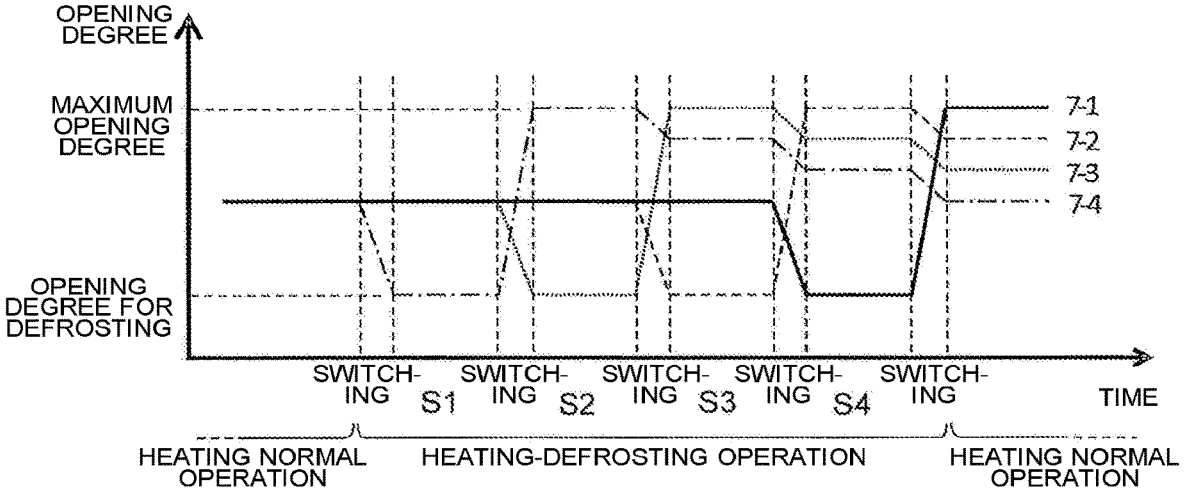
FIG. 10 is a schematic diagram illustrating, with respect to time, changes in the opening degree of a plurality of first flow control devices at the time of the heating-defrosting operation performed by the air-conditioning apparatus according to Embodiment 1 of the present disclosure.

An example of this control will be described with reference to FIG. 10. FIG. 10 is a schematic diagram illustrating, with respect to time, changes in the opening degree of the plurality of first flow control devices at the time of the heating-defrosting operation performed by the air-conditioning apparatus according to Embodiment 1 of the present disclosure. In the diagram illustrated in FIG. 10, the horizontal axis represents time and the vertical axis represents the opening degree of the first flow control devices 7-1 to 7-4. FIG. 10 illustrates a case where, when starting the heating-defrosting operation after the heating normal operation, the air-conditioning apparatus 100 performs defrosting in the order of the parallel heat exchangers 5-4, 5-3, 5-2, and 5-1 while setting a switching time for the open-close devices and so on and returns to the heating normal operation.

In FIG. 10, the state in which the parallel heat exchanger 5-4 is being defrosted is represented by S1, the state in which the parallel heat exchanger 5-3 is being defrosted is represented by S2, the state in which the parallel heat exchanger 5-2 is being defrosted is represented by S3, and the state in which the parallel heat exchanger 5-1 is being defrosted is represented by S4. In addition, in FIG. 10, the opening degree of the first flow control device 7-1 is illustrated with a solid line, the opening degree of the first flow control device 7-2 is illustrated with a broken line, the opening degree of the first flow control device 7-3 is illustrated with a dotted line, and the opening degree of the first flow control device 7-4 is illustrated with an alternate-long-and-short-dash line. Note that FIG. 10 illustrates that in a case where a parallel heat exchanger connected to a flow rate control device is to be defrosted, the opening degree of the flow rate control device is a minimum; however, the opening degree does not have to be necessarily a minimum.

In the case of controlling the opening degrees of the first flow control devices 7-1 to 7-4 on the basis of the order of defrosting, the controller 90 causes, for example, the opening degree of the first flow control device 7-4 to be the largest in the state S2, the first flow control device 7-4 being connected to the parallel heat exchanger 5-4, which is the target to be defrosted in the previous state S1. This is because since the parallel heat exchanger 5-4 is the target to be defrosted in the previous state S1, the amount of frost formed thereon is the smallest and the heat exchange efficiency between the refrigerant and outside air is the highest among the parallel heat exchangers 5-1, 5-2, and 5-4, which function as an evaporator, in the state S2. In the state S2, the controller 90 increases the flow rate of refrigerant flowing through the parallel heat exchanger 5-4 by causing the opening degree of the first flow control device 7-4 to be the largest.

In the state S3, the controller 90 causes the opening degree of the first flow control device 7-3 to be the largest, the first flow control device 7-3 being connected to the parallel heat exchanger 5-3, which is the target to be defrosted in the previous state S2. As a result, as described above, the flow rate of refrigerant flowing through the parallel heat exchanger 5-3, on which the smallest amount of frost is formed, becomes the highest, and the heat exchange efficiency between the refrigerant and outside air is increased. In the state S3, as illustrated in FIG. 10, the opening degree of the first flow control device 7-4 is smaller than that of the first flow control device 7-3 but larger than that of the first flow control device 7-1. The reason will be described. In the order of defrosting in the state S1, defrosting performed on the parallel heat exchanger 5-4 is at least later than the last defrosting performed on the parallel heat exchanger 5-1, and it is conceivable that the amount of frost formed on the parallel heat exchanger 5-4 is smaller than that of the parallel heat exchanger 5-1. Thus, it is because the efficiency of heat exchange between the refrigerant and outside air can be increased by causing the flow rate of refrigerant flowing through the parallel heat exchanger 5-4 to be higher than that of refrigerant flowing through the parallel heat exchanger 5-1.

Note that it is sufficient that, among the first flow control devices 7-1 to 7-4, the opening degrees of the first flow control devices connected to parallel heat exchangers functioning as an evaporator have a magnitude relationship as illustrated in FIG. 10, and the opening degree of the first flow control device connected to the parallel heat exchanger that has just been defrosted does not always have to be a maximum. The controller 90 causes, for example, the opening degree of the first flow control device 7-4 to be smaller than the maximum opening degree but larger than the opening degrees of the first flow control devices 7-1 and 7-2 in the state S2. In the state S3, the controller 90 does not change the opening degree of the first flow control device 7-4 and causes the opening degree of the first flow control device 7-3 to be the maximum opening degree. Even in this manner, the same magnitude relationship as the magnitude relationship illustrated in FIG. 10 can be maintained among the first flow control devices 7-1 to 7-4.

In addition, the controller 90 may also control the opening degrees of the first flow control devices 7-1 to 7-3 using the degrees of superheat of refrigerant. Specifically, the controller 90 calculates the degree of superheat of refrigerant downstream of each of the parallel heat exchangers 5-1 to 5-3 from the pressure of refrigerant detected by the first pressure detector 91 and refrigerant temperatures detected by the temperature detectors 92-1 to 92-3. The controller 90 then controls the opening degrees of the first flow control devices 7-1 to 7-3 such that the degrees of superheat of refrigerant of the parallel heat exchangers 5-1 to 5-3 are of the order of 0 to 3 degrees K or these degrees of superheat of refrigerant are substantially the same as each other. For example, in a case where the degree of superheat of refrigerant of the parallel heat exchanger 5-1 is greater than those of the other parallel heat exchangers 5-2 and 5-3, the controller 90 may increase the opening degree of the first flow control device 7-1 or decrease the opening degrees of the first flow control devices 7-2 and 7-3. The controller 90 controls the flow rates of refrigerant on the basis of the frost states obtained from the detection device and in accordance with the magnitudes of the amounts of frost formed on the parallel heat exchangers 5-1 to 5-3, which function as an evaporator, and thus the outdoor heat exchanger 5 can be efficiently used and the heating capacity during the continuous operation can be increased. In addition, the amount of frost formed on each parallel heat exchanger can be simply obtained by using the pressure detectors and temperature detectors in the detection device.

In addition, the controller 90 controls the opening degree of the third pressure reducing device 10 such that the flow rate of refrigerant flowing into the parallel heat exchanger 5-4, which is to be defrosted, and the necessary flow rate designed in advance for defrosting fall in a certain range, meaning that the flow rate of refrigerant matches the necessary flow rate. During the heating-defrosting operation, the difference between the discharge pressure of the compressor 1 and the pressure of the parallel heat exchanger 5-4, which is to be defrosted, does not change greatly, and thus the controller 90 may keep fixing the opening degree of the third pressure reducing device 10. The heating capacity can be increased by changing the pressure of refrigerant for performing defrosting to middle pressure and using condensation latent heat and also by reducing the amount of refrigerant for the parallel heat exchanger 5-4, which is to be defrosted.

Note that heat emitted from refrigerant for performing defrosting is not always transferred to frost formed on the parallel heat exchanger 5-4, and a portion of the heat may be emitted to outside air. Thus, the controller 90 may control the third pressure reducing device 10 and the first flow control device 7-4 such that the flow rate for defrosting increases as the outside air temperature decreases. As a result, regardless of changes in the outside air temperature, the amount of heat to be added to frost can be maintained constant and the time required for defrosting can be maintained constant.

Figure 11:
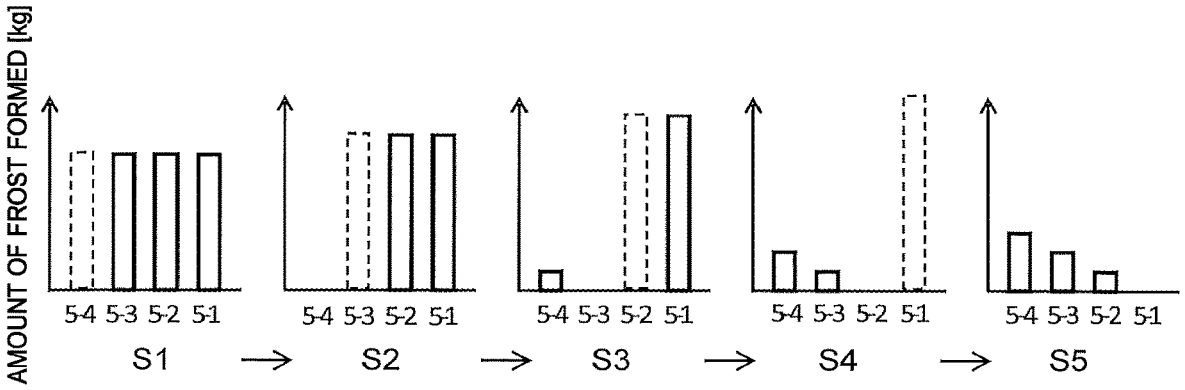
FIG. 11 is a diagram illustrating an example of changes in the amount of frost formed on individual parallel heat exchangers at the time of the heating-defrosting operation performed by the air-conditioning apparatus according to Embodiment 1 of the present disclosure.

Here, advantageous effects obtained by controlling the first flow control device connected to a parallel heat exchanger functioning as an evaporator among the parallel heat exchangers 5-1 to 5-4 will be described. FIG. 11 is a diagram illustrating an example of changes in the amount of frost formed on each parallel heat exchanger at the time of the heating-defrosting operation performed by the air-conditioning apparatus according to Embodiment 1 of the present disclosure. FIG. 11 illustrates changes in the amount of frost formed on each parallel heat exchanger in a case where defrosting is performed in the order of the parallel heat exchangers 5-4, 5-3, 5-2, and 5-1.

In FIG. 11, the vertical axis represents the amount of frost formed and the horizontal axis represents time. In addition, S1 to S5 illustrated in FIG. 11 represent temporal changes of states. A state S1 indicates a case where the parallel heat exchanger 5-4 is to be defrosted, a state S2 indicates a case where the parallel heat exchanger 5-3 is to be defrosted, a state S3 indicates a case where the parallel heat exchanger 5-2 is to be defrosted, and a state S4 indicates a case where the parallel heat exchanger 5-1 is to be defrosted. A state S5 indicates a state in which the heating-defrosting operation is completed. In FIG. 11, the amount of frost formed on a parallel heat exchanger functioning as an evaporator is illustrated with a solid line, and the amount of frost formed on a parallel heat exchanger to be defrosted is illustrated with a broken line.

When referring to FIG. 11, it is clear that in a case where the air-conditioning apparatus 100 performs to-be-defrosted target switching during the heating-defrosting operation, the frost states of parallel heat exchangers functioning as an evaporator among the parallel heat exchangers 5-1 to 5-4 vary depending of the order of defrosting. In the parallel heat exchanger on which a small amount of frost is formed, ventilation and heat transfer are not inhibited due to frost as much as in other parallel heat exchangers functioning as an evaporator, and the parallel heat exchanger on which a small amount of frost is formed enters a high heat exchange performance state. For example, in the state S2 of FIG. 11, the parallel heat exchanger 5-4 has higher heat exchange performance than the parallel heat exchangers 5-1 and 5-2. In addition, in the state S3 of FIG. 11, the parallel heat exchanger 5-3 has the highest heat exchange performance, and the parallel heat exchanger 5-1 has the lowest heat exchange performance.

In a case where the frost states of parallel heat exchangers functioning as an evaporator vary, when refrigerant flows at the same flow rate through all of these parallel heat exchangers, refrigerant tends to evaporate at the parallel heat exchanger on which a small amount of frost is formed and which has high heat exchange performance. Thus, in the parallel heat exchanger having high heat exchange performance, two-phase gas-liquid refrigerant that has flowed thereinto becomes single-phase gas refrigerant at a shorter heat transfer tube length than the other parallel heat exchangers, a single-phase gas region increases, and the degree of superheat of refrigerant increases. Single-phase gas has a lower heat transfer rate than two-phase gas-liquid, and cannot efficiently receive heat from outside air. In contrast, in the parallel heat exchanger on which a large amount of frost is formed and which has low heat exchange performance, two-phase gas-liquid refrigerant that has flowed thereinto cannot be changed to single-phase gas, a portion of liquid refrigerant, which can be effectively used to exchange heat, remains and refrigerant still in the form of two-phase gas-liquid flows out from the heat exchanger. In this case, too, heat cannot be efficiently removed from outside air.

This is why the controller 90 controls the opening degrees of the first flow control devices 7-1 to 7-4, changes the flow resistance of the first flow control devices connected to parallel heat exchangers functioning as an evaporator, and controls the flow rates of refrigerant in accordance with the frost states of the parallel heat exchangers. Specifically, the controller 90 increases the flow rate of refrigerant of the parallel heat exchanger on which a small amount of frost is formed and which has high heat exchange performance and decreases the flow rate of refrigerant of the parallel heat exchanger on which a large amount of frost is formed and which has low heat exchange performance. As a result, a larger amount of liquid refrigerant evaporates at the parallel heat exchanger having high heat exchange performance, and heat can be efficiently removed from outside air. As a result, the heating capacity can be increased.

When controlling the first flow control devices 7-1 to 7-4, the controller 90 may determine the magnitudes of the amounts of frost formed on the parallel heat exchangers 5-1 to 5-4, in the order of defrosting or in accordance with the magnitude relationship of the degrees of superheat of refrigerant. In a case where a determination is made in the order of defrosting, the controller 90 determines the magnitude relationship of the amounts of frost formed, by considering that the parallel heat exchanger that has just been defrosted has the smallest amount of frost formed and the parallel heat exchanger that has been defrosted immediately before the parallel heat exchanger has the next smallest amount of frost formed. That is, the controller 90 determines that the latter the order of defrosting of the parallel heat exchanger is, the smaller amount of frost is formed thereon. In this case, the controller 90 can determine the magnitude relationship of the amounts of frost formed, by using a simple method even if measurement values from the first pressure detector 91 and the temperature detectors 92-1 to 92-4 are not used.

In contrast, in a case where the magnitudes of the amounts of frost formed are determined in accordance with the magnitude relationship of the degrees of superheat of refrigerant, the controller 90 determines the magnitude relationship of the amounts of frost formed, such that the parallel heat exchanger having the highest degree of superheat of refrigerant has the smallest amount of frost formed and the parallel heat exchanger having the lowest degree of superheat of refrigerant has the largest amount of frost formed. In this case, even when the amounts of frost formed change due to factors other than the order of defrosting such as the difference in the volume of air flow at each parallel heat exchanger, the controller 90 can more accurately determine the magnitude relationship of the amounts of frost formed.

As described above, the controller 90 controls, using the first flow control devices connected to parallel heat exchangers functioning as an evaporator among the parallel heat exchangers 5-1 to 5-4, the flow rates of refrigerant flowing into the parallel heat exchangers in accordance with the frost states of the parallel heat exchangers. As a result, the heating capacity is increased and the degree of comfort in the indoor space can be increased.

Note that there may be a case where even during the heating normal operation after the air-conditioning apparatus 100 has performed the heating-defrosting operation, the frost states of the parallel heat exchangers 5-1 to 5-4 are different. Thus, the controller 90 may control the opening degrees of the first flow control devices 7-1 to 7-4 such that the flow rates of refrigerant change in accordance with the frost states of the parallel heat exchangers 5-1 to 5-4. For example, since the parallel heat exchanger selected as the last target to be defrosted in the last heating-defrosting operation has the smallest amount of frost formed compared with the other parallel heat exchangers, the controller 90 sets the flow rate of refrigerant of this parallel heat exchanger to be higher than those of the other parallel heat exchangers.

In addition, the controller 90 may also control the opening degrees of the first flow control devices 7-1 to 7-4 using the degrees of superheat of refrigerant. Specifically, the controller 90 calculates the degree of superheat of refrigerant downstream of each of the parallel heat exchangers 5-1 to 5-4 from measurement values from the first pressure detector 91 and the temperature detectors 92-1 to 92-4. The controller 90 may then control the opening degrees of the first flow control devices 7-1 to 7-4 such that the degrees of superheat of refrigerant of the parallel heat exchangers 5-1 to 5-4 are of the order of 0 to 3 degrees K or these degrees of superheat of refrigerant are substantially the same as each other.

In this manner, also during the heating normal operation, advantageous effects similar to those of the case where the first flow control devices connected to the parallel heat exchangers functioning as an evaporator at the time of the heating-defrosting operation are controlled are obtained, the heating capacity is increased, and the degree of comfort in an indoor space that is to be an air-conditioned space can be increased.

In addition, the controller 90 may also change, for example, a threshold for the saturation temperature of refrigerant and used when the presence or absence of frost formed is determined in accordance with outside air temperature or a time for the heating normal operation. That is, an operation time is shortened to reduce the amount of frost formed and present at the time when defrosting is started as the outside air temperature decreases such that the amount of heat for defrosting and supplied from refrigerant is maintained constant during defrosting. As a result, the resistance of the third pressure reducing device 10 is maintained constant and inexpensive capillary tubes can be used.

In addition, the controller 90 may change, in accordance with outside air temperature, the number of parallel heat exchangers to be defrosted. In a case where the outside air temperature is high, a smaller amount of heat is emitted into outside air from the parallel heat exchanger to be defrosted, and defrosting is performed more easily. Thus, even when the number of heat exchangers to be defrosted is increased, defrosting can be performed, and the time necessary for defrosting all the parallel heat exchangers to be defrosted can be shortened by increasing the number of parallel heat exchanger that are simultaneously defrosted. In addition, in a case where the necessary heating capacity is low, the controller 90 can shorten the time necessary for defrosting all the parallel heat exchangers to be defrosted, by increasing the number of parallel heat exchangers to be defrosted.

In addition, the controller 90 may also change the number of parallel heat exchangers to be defrosted, in accordance with the heating load of the indoor space. In a case where the heating load of the indoor space is light, it is sufficient that the flow rate of refrigerant flowing through the indoor unit be low, and thus the flow rate of refrigerant flowing through the parallel heat exchanger to be defrosted can be increased. As a result, even when the number of heat exchangers to be defrosted is increased, a sufficient defrosting capacity can be obtained, and thus the entire defrosting time necessary for defrosting all the parallel heat exchangers to be defrosted can be shortened by increasing the number of parallel heat exchangers that are simultaneously defrosted. The heating load of the indoor space can be obtained through calculation, for example, by the controller 90 using at least one value from among the pressure of refrigerant discharged from the compressor, the capacity of the indoor unit in operation, the number of indoor units in operation, the temperature difference between an indoor set temperature and indoor temperature, and so on.

In addition, in a case where the parallel heat exchangers 5-1 to 5-4 are integrally formed as illustrated in FIG. 2 and the outdoor fan 5*f* supplies outside air to the parallel heat exchanger or exchangers to be defrosted, the output of the outdoor fan 5*f* may be changed in accordance with outside air temperature to reduce the amount of heat emitted at the time of the heating-defrosting operation. In this case, defrosting can be completed faster by reducing the amount of heat emitted to air from the parallel heat exchanger or exchangers to be defrosted. In addition, the heat addition capacity for defrosting is reduced by the amount by which the amount of heat emitted has been reduced, and the heating capacity can be increased by using as the heating capacity the heat addition capacity corresponding to the amount by which the heat addition capacity has been reduced.

[Control Flow Chart]

Figure 12:
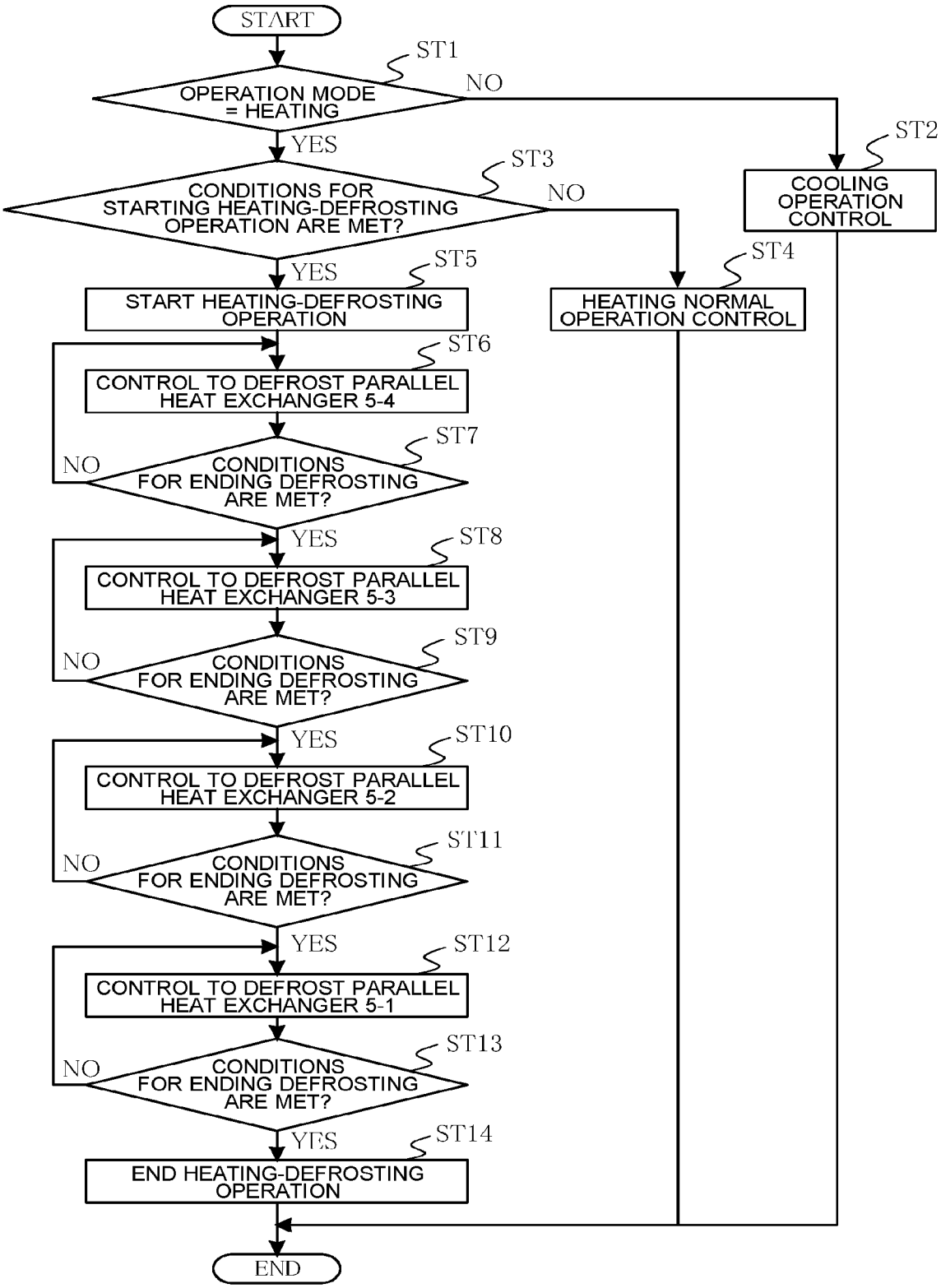
FIG. 12 is a flow chart illustrating control performed by a controller of the air-conditioning apparatus according to Embodiment 1 of the present disclosure.

FIG. 12 is a flow chart illustrating control performed by the controller of the air-conditioning apparatus according to Embodiment 1 of the present disclosure. In FIG. 12, a case where defrosting is performed in the order of the parallel heat exchangers 5-4, 5-3, 5-2, and 5-1 in the heating-defrosting operation is illustrated as an example; however, the order of defrosting is not limited to that described in this case.

When the air-conditioning apparatus 100 starts operating, the controller 90 determines whether the operation mode is the heating operation or the cooling operation (step ST1). In a case where the operation mode is the cooling operation, the controller 90 performs cooling operation control (step ST2). In contrast, in a case where the determination in step ST1 indicates that the operation mode is the heating operation, the controller 90 determines whether the conditions for starting the heating-defrosting operation are met (step ST3). In a case where the conditions for starting the heating-defrosting operation are not met, the controller 90 performs heating normal operation control (step ST4).

In a case where the determination in step ST3 indicates that the conditions for starting the heating-defrosting operation are met, the controller 90 starts the heating-defrosting operation (step ST5), and performs control to defrost the parallel heat exchanger 5-4 (step ST6). While defrosting the parallel heat exchanger 5-4, the controller 90 determines whether the conditions for ending defrosting are met (step ST7). In a case where the conditions for ending defrosting are not met, the controller 90 continues to defrost the parallel heat exchanger 5-4. In a case where the conditions for ending defrosting are met, the controller 90 performs control to defrost the parallel heat exchanger 5-3, which is to be defrosted next, (step ST8).

Thereafter, similarly to the case of defrosting of the parallel heat exchanger 5-4, the controller 90 determines whether the conditions for ending defrosting are met while defrosting the parallel heat exchanger 5-3 (step ST9 and step ST11). In a case where the conditions for ending defrosting are met, the controller 90 performs control to defrost the parallel heat exchanger that is to be defrosted next (steps ST10 and ST12). The controller 90 determines whether the conditions for ending are met for the parallel heat exchanger 5-1, which is to be defrosted last, (step ST13). In a case where the conditions for ending defrosting are met, the controller 90 ends the heating-defrosting operation (step ST14).

The air-conditioning apparatus 100 of Embodiment 1 controls, in the heating-defrosting mode or the heating operation mode, the flow rates of refrigerant flowing into the parallel heat exchangers functioning as an evaporator by controlling the first flow control devices connected to the parallel heat exchangers in accordance with the frost states of the parallel heat exchangers. In Embodiment 1, since the flow rates of refrigerant flowing through the parallel heat exchangers functioning as an evaporator are controlled in accordance with the frost states of the parallel heat exchangers, defrosting can be efficiently performed without stopping heating, and the outdoor heat exchanger 5 can be efficiently used. As a result, the heating capacity is increased, and the degree of comfort in the air-conditioned space can be increased.

Embodiment 2

Figure 13:
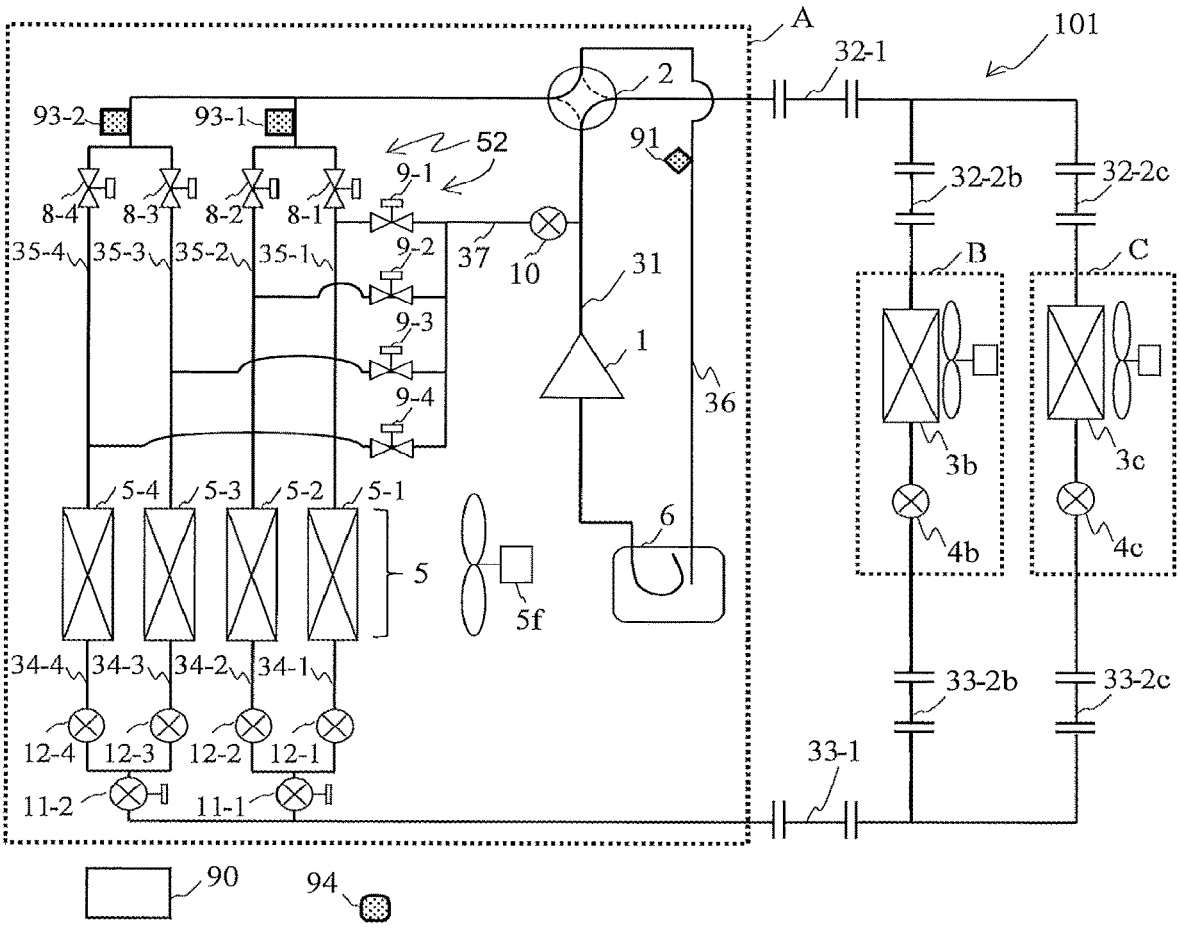
FIG. 13 is a refrigerant circuit diagram illustrating a refrigerant circuit configuration of an air-conditioning apparatus according to Embodiment 2 of the present disclosure.

The configuration of an air-conditioning apparatus according to Embodiment 2 will be described. FIG. 13 is a refrigerant circuit diagram illustrating a refrigerant circuit configuration of the air-conditioning apparatus according to Embodiment 2 of the present disclosure. In Embodiment 2, configurations that differ from those of Embodiment 1 are mainly described and a description of the configurations similar to those of Embodiment 1 will be omitted.

When compared with the air-conditioning apparatus 100 illustrated in FIG. 1, an air-conditioning apparatus 101 according to Embodiment 2 includes second flow control devices 11-1 and 11-2 and second pressure reducing devices 12-1 to 12-4 instead of the first flow control devices 7-1 to 7-4. The second flow control device 11-1 is connected to the parallel heat exchangers 5-1 and 5-2. The second flow control device 11-2 is connected to the parallel heat exchangers 5-3 and 5-4.

The second pressure reducing device 12-1 is connected between the parallel heat exchanger 5-1 and the second flow control device 11-1. The second pressure reducing device 12-2 is connected between the parallel heat exchanger 5-2 and the second flow control device 11-1. The second pressure reducing device 12-3 is connected between the parallel heat exchanger 5-3 and the second flow control device 11-2. The second pressure reducing device 12-4 is connected between the parallel heat exchanger 5-4 and the second flow control device 11-2.

In addition, the air-conditioning apparatus 101 is provided with temperature detectors 93-1 and 93-2 instead of the temperature detectors 92-1 to 92-4 illustrated in FIG. 1. The temperature detector 93-1 is provided between the first open-close devices 8-1 and 8-2 and the cooling-heating switching device 2. The temperature detector 93-2 is provided between the first open-close devices 8-3 and 8-4 and the cooling-heating switching device 2. In Embodiment 2, the first pressure detector 91 and the temperature detectors 93-1 and 93-2 serve as a detection device for detecting a value for determining the frost state of each parallel heat exchanger that functions as an evaporator among the parallel heat exchangers 5-1 to 5-4.

The second flow control devices 11-1 and 11-2 are a valve that can change its opening degree in accordance with a control signal input from the controller 90. The second flow control devices 11-1 and 11-2 are constituted by, for example, an electronic control expansion valve. It is sufficient that the second pressure reducing devices 12-1 to 12-4 be devices that can reduce the pressure of refrigerant, and the second pressure reducing devices 12-1 to 12-4 may also be, for example, a capillary tube or an expansion valve.

Figure 14:
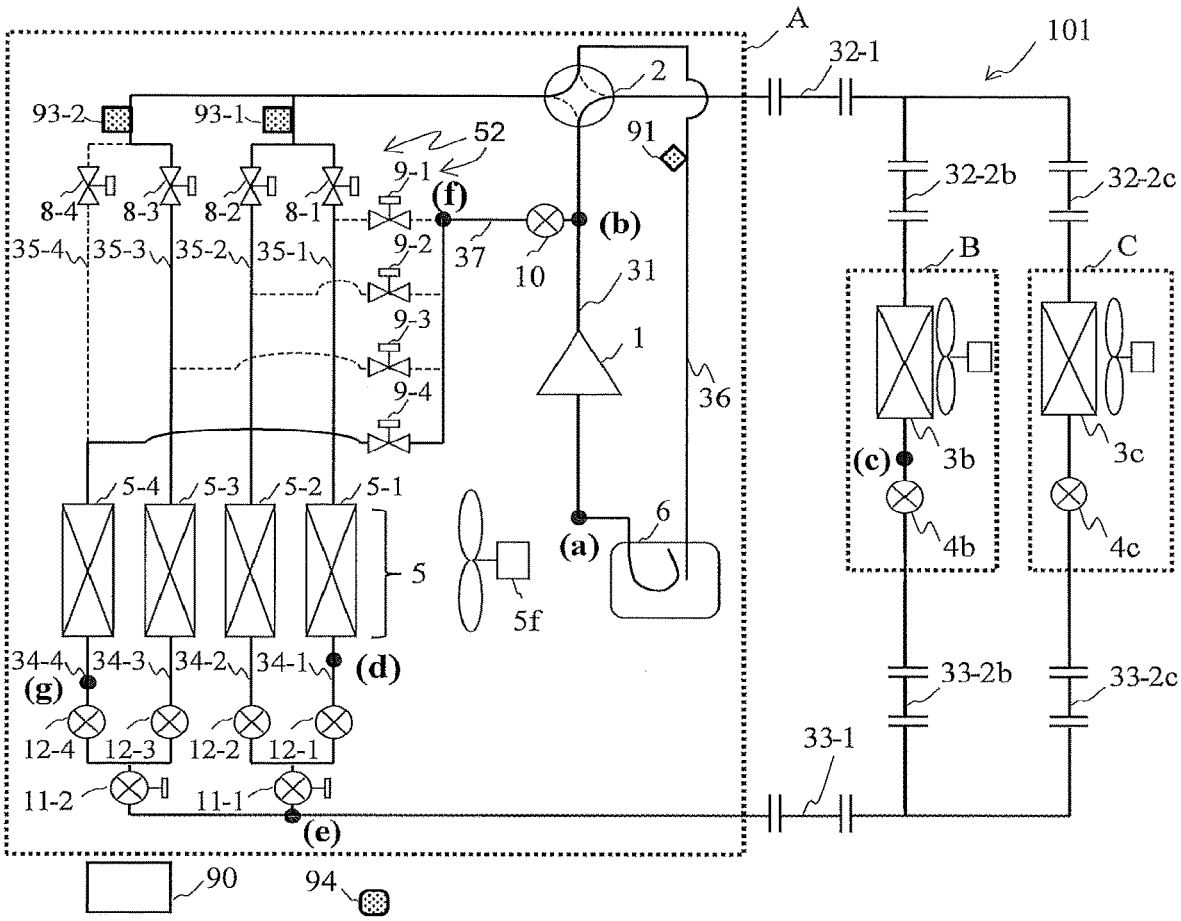
FIG. 14 is a diagram illustrating the flow of refrigerant at the time of a heating-defrosting operation performed by the air-conditioning apparatus according to Embodiment 2 of the present disclosure.

The flow of refrigerant at the time of the heating-defrosting operation performed by the air-conditioning apparatus 101 of Embodiment 2 will be described. In Embodiment 2, operations that differ from those of Embodiment 1 are mainly described and a description of the operations similar to those of Embodiment 1 will be omitted. FIG. 14 is a diagram illustrating the flow of refrigerant at the time of the heating-defrosting operation performed by the air-conditioning apparatus according to Embodiment 2 of the present disclosure.

In FIG. 14, a pipe portion where refrigerant flows at the time of the heating-defrosting operation is illustrated with a solid line and a pipe portion where refrigerant does not flow is illustrated with a broken line. In this case, as illustrated in FIG. 14, a case where the parallel heat exchanger 5-4 is to be defrosted and heating is continued by causing the parallel heat exchangers 5-1 to 5-3 to function as an evaporator will be described. Refrigerant states at points (a) to (g) of FIG. 14 are represented by portions denoted by points (a) to (g) of the P-h diagram illustrated in FIG. 9.

In a case where, while performing the heating normal operation, the controller 90 determines that defrosting to solve the frost state is necessary, the controller 90 closes the first open-close device 8-4, corresponding to the parallel heat exchanger 5-4, which is to be defrosted. Subsequently, the controller 90 opens the second open-close device 9-4, and opens the third pressure reducing device 10 to achieve a set opening degree. As a result, a defrost circuit is formed in which refrigerant flow paths are connected in the order of the compressor 1, the third pressure reducing device 10, the second open-close device 9-4, the parallel heat exchanger 5-4, and the second pressure reducing device 12-4, and the heating-defrosting operation is started.

When the air-conditioning apparatus 101 starts the heating-defrosting operation, a portion of the refrigerant discharged from the compressor 1 flows into the bypass pipe 37, passes through the third pressure reducing device 10 and then through the second open-close device 9-4, and flows into the parallel heat exchanger 5-4. The refrigerant flowing out from the parallel heat exchanger 5-4 undergoes a reduction in pressure at the second pressure reducing device 12-4 and then merges with refrigerant flowing from the second flow control device 11-2 into the second pressure reducing device 12-3. The refrigerant that has passed through the second pressure reducing device 12-3 flows into the parallel heat exchanger 5-3, which functions as an evaporator, and evaporates.

In Embodiment 2, in the heating-defrosting operation or the heating normal operation, the controller 90 controls the opening degrees of the second flow control devices 11-1 and 11-2 such that the flow rate of refrigerant of the parallel heat exchanger that has just been defrosted is increased. For example, in a case where the controller 90 defrosts the parallel heat exchanger 5-4 after defrosting the parallel heat exchanger 5-3, the controller 90 performs control to increase the opening degree of the second flow control device 11-2, which is connected to the parallel heat exchanger 5-3. In that case, the controller 90 may perform control to reduce the opening degree of the second flow control device 11-1, which is connected to the parallel heat exchangers 5-1 and 5-2, instead of control to increase the opening degree of the second flow control device 11-2.

In addition, the controller 90 may also control the opening degrees of the second flow control devices 11-1 and 11-2 using the degrees of superheat of refrigerant. Specifically, the controller 90 calculates the degree of superheat of refrigerant into which the refrigerant from the parallel heat exchanger 5-1 and the refrigerant from the parallel heat exchanger 5-2 have merged and the degree of superheat of refrigerant of the parallel heat exchanger 5-3 from the pressure of refrigerant detected by the first pressure detector 91 and refrigerant temperatures detected by the temperature detectors 93-1 and 93-2. The controller 90 then controls the opening degrees of the second flow control devices 11-1 and 11-2 such that these degrees of superheat of refrigerant are of the order of 0 to 3 degrees K or these degrees of superheat of refrigerant are substantially the same as each other. For example, in a case where the degree of superheat of refrigerant after the refrigerant from the parallel heat exchanger 5-1 merges with the refrigerant from the parallel heat exchanger 5-2 is greater than that of the parallel heat exchanger 5-3, the controller 90 may increase the opening degree of the second flow control device 11-1 or decrease the opening degree of the second flow control device 11-2.

In the air-conditioning apparatus 101 of Embodiment 2, in accordance with the operation state, the parallel heat exchangers 5-1 and 5-2 are combined as one evaporator and the parallel heat exchangers 5-3 and 5-4 are combined as one evaporator. The parallel heat exchangers 5-1 and 5-2, which are combined as one evaporator, are provided with the second flow control device 11-1 and the temperature detector 93-1. In addition, the parallel heat exchangers 5-3 and 5-4, which are combined as one evaporator, are provided with the second flow control device 11-2 and temperature detector 93-2. According to Embodiment 2, the heating capacity is increased by flow rate control performed in accordance with the frost states of the parallel heat exchangers, and not only the degree of comfort in the indoor space can be increased but also the number of flow rate control devices that need to be controlled is reduced compared with Embodiment 1. Thus, the control can be simplified. In addition, the number of flow rate control devices and the number of temperature detectors are reduced, and thus the manufacturing cost is lower than that of Embodiment 1. Furthermore, in a case where the controller 90 determines the magnitude relationship of the frost states using the degrees of superheat of refrigerant, it is sufficient that measurement values detected by the temperature detectors 93-1 and 93-2 be used as refrigerant temperatures, and thus the arithmetic processing load is lighter than that of Embodiment 1.

In Embodiment 2, the case where, depending on the operation state, the combination of the parallel heat exchangers 5-1 and 5-2 is treated as one evaporator and the combination of the parallel heat exchangers 5-3 and 5-4 is treated as one evaporator has been described; however, either of the two combinations may have substantially the same configuration as that of Embodiment 1. For example, the first flow control device 7-3 may be connected to the parallel heat exchanger 5-3, and the first flow control device 7-4 may be connected to the parallel heat exchanger 5-4. Even in this case, the number of flow rate control devices is reduced by one from that of Embodiment 1, and thus the control can be simplified and the manufacturing cost can be reduced.

Furthermore, in Embodiment 2, when to-be-defrosted target switching is performed, it is desirable that the parallel heat exchanger connected to the second flow control device to which the parallel heat exchanger that has just been defrosted is connected be selected in a prioritized manner. For example, in a case where the controller 90 has defrosted the parallel heat exchanger 5-1, the controller 90 selects the parallel heat exchanger 5-2 as the next target to be defrosted. Subsequently, after defrosting the parallel heat exchanger 5-2, the controller 90 selects the parallel heat exchanger 5-3 or 5-4 as the next target to be defrosted. Accordingly, after the parallel heat exchanger 5-2 is defrosted, the amounts of frost formed on the parallel heat exchangers 5-1 and 5-2 are smaller than the amounts of frost formed on the parallel heat exchangers 5-3 and 5-4. When the parallel heat exchangers 5-1 and 5-2 are considered to be one evaporator, variations in each of the magnitude relationship of the amounts of frost formed and the magnitude relationship of the flow rates of refrigerant can be reduced between evaporators.

Embodiment 3

Figure 15:
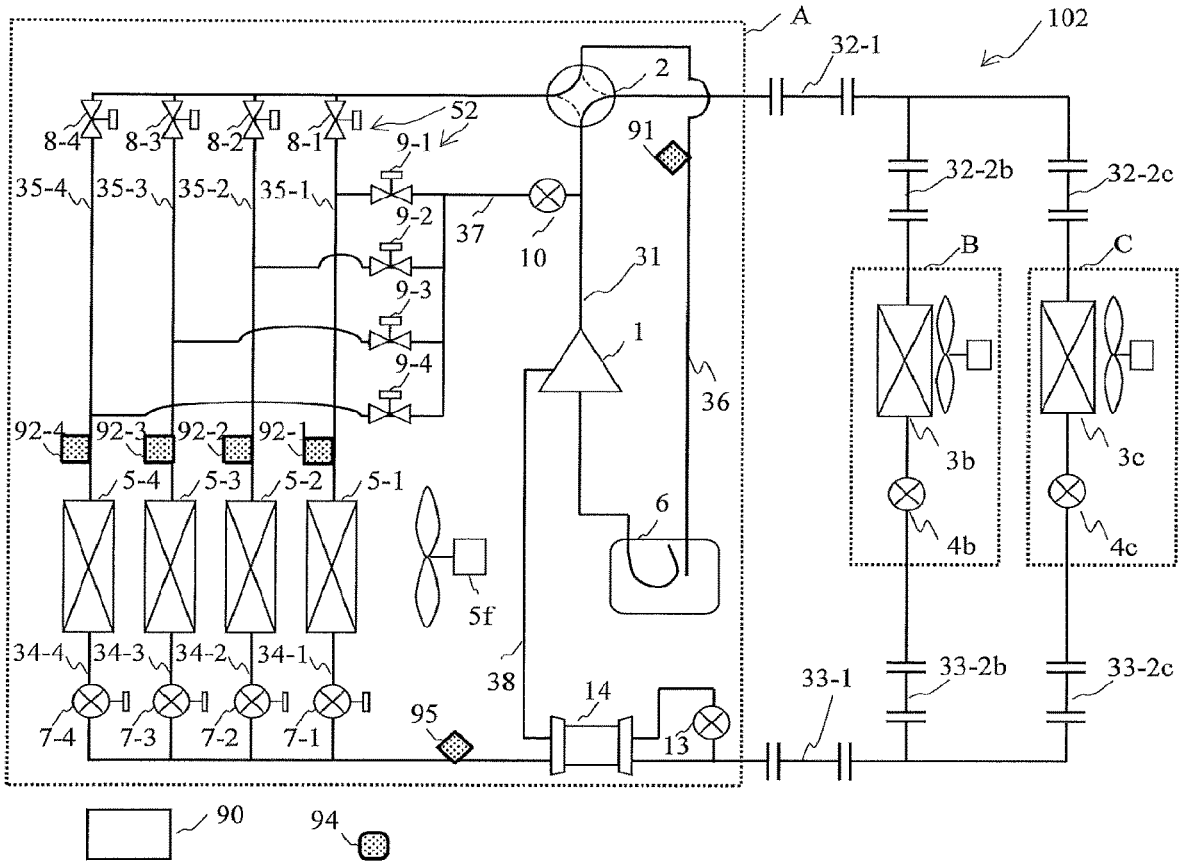
FIG. 15 is a refrigerant circuit diagram illustrating a refrigerant circuit configuration of an air-conditioning apparatus according to Embodiment 3 of the present disclosure.

The configuration of an air-conditioning apparatus according to Embodiment 3 will be described. FIG. 15 is a refrigerant circuit diagram illustrating a refrigerant circuit configuration of the air-conditioning apparatus according to Embodiment 3 of the present disclosure. In Embodiment 3, configurations that differ from those of Embodiment 1 are mainly described and a description of the configurations similar to those of Embodiment 1 will be omitted.

Compared with the air-conditioning apparatus 100 illustrated in FIG. 1, an air-conditioning apparatus 102 according to Embodiment 3 includes an injection pipe 38, which is branched from between the second extension pipe 33-1 and the first flow control devices 7-1 to 7-4 and which is connected to the compressor 1, and a fourth pressure reducing device 13, which is provided at the injection pipe 38. In addition, in the configuration illustrated in FIG. 15, a refrigerant-refrigerant heat exchanger 14 for exchanging heat between refrigerant that has flowed into the injection pipe 38 and undergone a reduction in pressure at the fourth pressure reducing device 13 and main-stream refrigerant flowing into the first flow control devices 7-1 to 7-4 without being diverted is provided; however, the refrigerant-refrigerant heat exchanger 14 does not have to be necessarily provided. In addition, a gas-liquid separation device may be provided at the branching portion and may be configured such that liquid refrigerant is unevenly divided between and flows into the paths.

On the side where the injection pipe 38 is connected to the compressor 1, as in FIG. 15, the injection pipe 38 is directly connected to the compressor 1 or connected to a suction side pipe of the compressor 1. As in FIG. 15, in a case where the injection pipe 38 is directly connected to the compressor 1, the compressor 1 is provided with a port through which refrigerant flows into a suction section or a middle section of the compression process in a compression chamber (unillustrated), and an end portion of the injection pipe 38 is connected to this port.

In addition, in the air-conditioning apparatus 102, a second pressure detector 95 for detecting the pressure of refrigerant is provided between the second extension pipe 33-1 and the first flow control devices 7-1 to 7-4. It is sufficient that the second pressure detector 95 detect the pressure of refrigerant at the branching portion of the injection pipe 38, and the second pressure detector 95 may also be provided between the branching portion and the fourth pressure reducing device 13. Instead of the pressure detector, a temperature detector that can detect refrigerant temperature may be provided at a pipe portion where refrigerant enters a two-phase gas-liquid state. A value detected by the temperature detector is treated as the saturation temperature of refrigerant, and the pressure of refrigerant may be converted from the saturation temperature of refrigerant.

It is sufficient that the fourth pressure reducing device 13 be a device that can reduce the pressure of refrigerant that has flowed into the injection pipe, and thus the fourth pressure reducing device 13 may also be a capillary tube or a solenoid valve, or may also be, for example, an electronic control expansion valve, which can change its opening degree in accordance with a control signal input from the controller 90.

Figure 16:
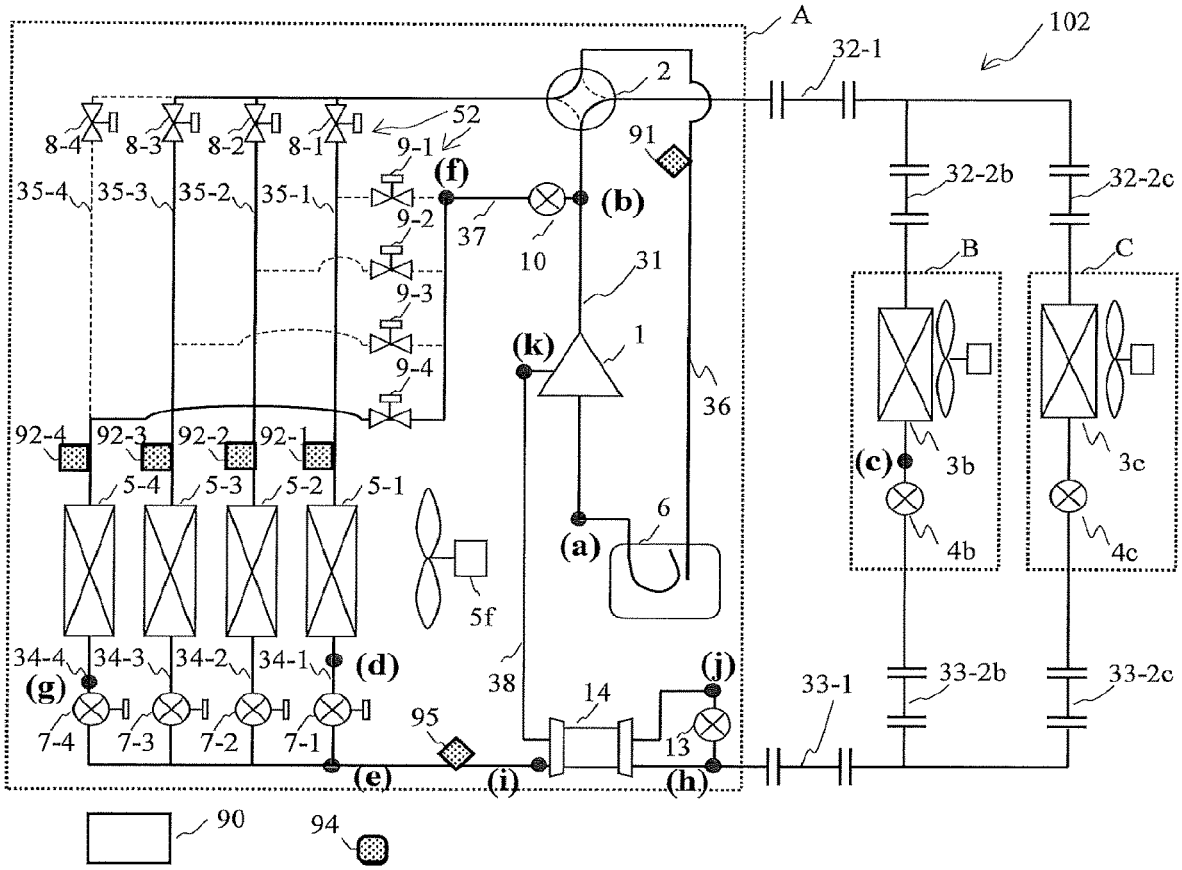
FIG. 16 is a diagram illustrating the flow of refrigerant at the time of a heating-defrosting operation performed by the air-conditioning apparatus according to Embodiment 3 of the present disclosure.

The flow of refrigerant at the time of the heating-defrosting operation performed by the air-conditioning apparatus 102 of Embodiment 3 will be described. In Embodiment 3, operations that differ from those of Embodiment 1 are mainly described and a description of the operations similar to those of Embodiment 1 will be omitted. FIG. 16 is a diagram illustrating the flow of refrigerant at the time of the heating-defrosting operation performed by the air-conditioning apparatus according to Embodiment 3 of the present disclosure.

Figure 17:
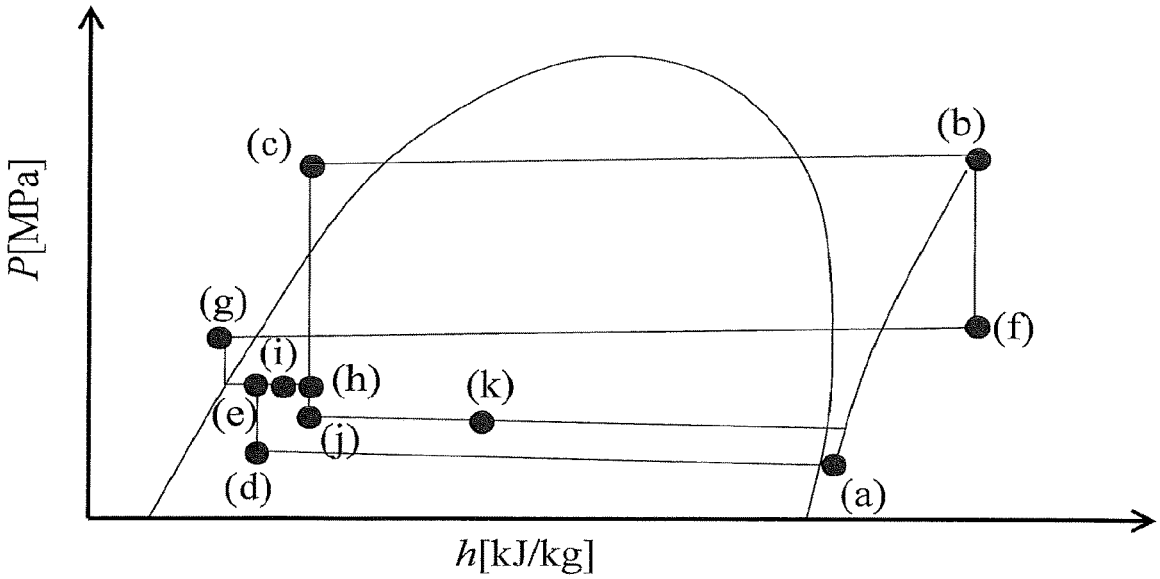
FIG. 17 is a P-h diagram at the time of the heating-defrosting operation performed by the air-conditioning apparatus according to Embodiment 3 of the present disclosure.

In FIG. 16, a pipe portion where refrigerant flows at the time of the heating-defrosting operation is illustrated with a solid line and a pipe portion where refrigerant does not flow is illustrated with a broken line. In this case, as illustrated in FIG. 16, a case where the parallel heat exchanger 5-4 is to be defrosted and heating is continued by causing the parallel heat exchangers 5-1 to 5-3 to function as an evaporator will be described. FIG. 17 is a P-h diagram at the time of the heating-defrosting operation performed by the air-conditioning apparatus according to Embodiment 3 of the present disclosure. Refrigerant states at points (a) to (k) of FIG. 16 are represented by portions denoted by points (a) to (k) of the P-h diagram illustrated in FIG. 17.

In a case where, while performing the heating normal operation, the controller 90 determines that defrosting to solve the frost state is necessary, the controller 90 closes the first open-close device 8-4, corresponding to the parallel heat exchanger 5-4, which is to be defrosted. Subsequently, the controller 90 opens the second open-close device 9-4, and opens the third pressure reducing device 10 to achieve a set opening degree. As a result, a defrost circuit is formed in which refrigerant flow paths are connected in the order of the compressor 1, the third pressure reducing device 10, the second open-close device 9-4, the parallel heat exchanger 5-4, and the first flow control device 7-4, and the heating-defrosting operation is started.

In the air-conditioning apparatus 102, the refrigerant that has flowed into the outdoor unit A through the second extension pipes is divided at the branching portion, and a portion of the refrigerant flows into the injection pipe 38 and another portion of the refrigerant flows into the first flow control devices 7-1 to 7-3, which are connected to the parallel heat exchangers 5-1 to 5-3, which function as an evaporator. The refrigerant flowing into the first flow control devices 7-1 to 7-3 is the main-stream refrigerant.

The refrigerant that has flowed into the injection pipe 38 flows through the fourth pressure reducing device 13 to undergo a reduction in pressure. The change in the refrigerant in this case is represented by the line from point (h) to point (j) illustrated in FIG. 17. The refrigerant, the pressure of which is reduced, passes through the refrigerant-refrigerant heat exchanger 14 to be heated by the main-stream refrigerant, the pressure of which is high, and flows into the compressor 1. The change in the refrigerant caused by the refrigerant-refrigerant heat exchanger 14 is represented by the line from point (j) to point (k) illustrated in FIG. 17. Note that point (k) illustrated in FIG. 17 is positioned in a region where refrigerant is in a two-phase gas-liquid state; however, depending on the amount of heat added at the refrigerant-refrigerant heat exchanger or a gas-liquid separation state at the branching portion, point (k) may be positioned in a region corresponding to a single-phase gas state.

The main-stream refrigerant, which is not diverted at the branching portion and flows into the first flow control devices 7-1 to 7-3, is cooled by the low-pressure refrigerant in the injection pipe 38 at the refrigerant-refrigerant heat exchanger 14. This change is represented by the line from point (h) to point (i) illustrated in FIG. 17.

Note that in a case where the refrigerant-refrigerant heat exchanger 14 is not provided, the change caused by heating the refrigerant in the injection pipe 38 and cooling the main-stream refrigerant does not occur, and the refrigerant that has flowed into the injection pipe 38 undergoes a reduction in pressure at the fourth pressure reducing device 13 and flows into the compressor 1.

In Embodiment 3, in the heating-defrosting operation or the heating normal operation, the controller 90 controls the total opening degree of the first flow control devices 7-1 to 7-3 so that the pressure of refrigerant at the branching portion and detected by the second pressure detector 95 becomes a predetermined value, and controls, while satisfying the total opening degree, the opening degree of each of the first flow control devices 7-1 to 7-3 such that the flow rate of refrigerant of the parallel heat exchanger that has just been defrosted is increased. For example, in a case where the controller 90 defrosts the parallel heat exchanger 5-4 after defrosting the parallel heat exchanger 5-3, first, the controller 90 determines the total opening degree of the first flow control devices 7-1 to 7-3 so that the pressure of refrigerant at the branching portion becomes the predetermined value. Next, with the determined total opening degree, the controller 90 performs control such that the opening degree of the first flow control device 7-1, which is connected to the parallel heat exchanger 5-3, becomes larger than the opening degrees of the first flow control devices 7-2 and 7-3, which are other first flow control devices. In that case, the controller 90 may perform control to reduce the opening degrees of the first flow control devices 7-2 and 7-3 instead of control to increase the opening degree of the first flow control device 7-1.

In addition, after determining the total opening degree of the first flow control devices 7-1 to 7-3 so that the pressure of refrigerant at the branching portion becomes the predetermined value, the controller 90 may control the opening degree of each of the first flow control devices 7-1 to 7-3 using the degrees of superheat of refrigerant calculated from the pressure of refrigerant detected by the first pressure detector 91 and refrigerant temperatures detected by the temperature detectors 92-1 to 92-3. Specifically, the controller 90 controls the opening degrees of the first flow control devices 7-1 to 7-3 such that the degrees of superheat of refrigerant of the parallel heat exchangers 5-1 to 5-3 are of the order of 0 to 3 degrees K or these degrees of superheat of refrigerant are substantially the same as each other. For example, in a case where the degree of superheat of refrigerant of the parallel heat exchanger 5-1 is greater than those of the parallel heat exchangers 5-2 and 5-3, which are other parallel heat exchangers, the controller 90 may increase the opening degree of the first flow control device 7-1, and close the first flow control devices 7-2 and 7-3 by the amount by which the first flow control device 7-1 is opened so that the determined total opening degree is achieved, or close the first flow control devices 7-2 and 7-3 and open the first flow control device by the amount by which the first flow control devices 7-2 and 7-3 are closed.

Here, advantageous effects obtained by controlling the total opening degree of the first flow control devices, which are connected to parallel heat exchangers functioning as an evaporator among the parallel heat exchangers 5-1 to 5-4 in Embodiment 3, will be described.

Compared with Embodiment 1, the heating capacity can be increased in Embodiment 3 by providing the injection pipe 38 and causing two-phase gas-liquid refrigerant or gas refrigerant to flow into the compressor 1. For example, by causing two-phase gas-liquid refrigerant or gas refrigerant to flow into the compression chamber of the compressor 1, the density of refrigerant in the compression chamber can be increased and the flow rate of refrigerant discharged from the compressor can be increased, and as a result the heating capacity is increased. In addition, in a case where an upper limit is set for the temperature of refrigerant discharged from the compressor 1 and the higher the frequency of the compressor 1, the more easily the refrigerant temperature increases, the temperature of the refrigerant can be reduced by causing two-phase gas-liquid refrigerant to flow into the compressor 1. As a result, the compressor 1 can be operated at higher frequency, and thus the flow rate of refrigerant can be increased and the heating capacity can be increased. However, to increase the heating capacity using the injection pipe 38, refrigerant needs to flow into the injection pipe 38 at a predetermined flow rate, and the pressure of refrigerant at the branching portion, which is an inlet of the injection pipe 38, needs to be maintained at a predetermined value to ensure the flow rate of refrigerant.

Thus, the flow rate of refrigerant necessary for the injection pipe 38 can be ensured by controlling the total opening degree of the first flow control devices, which are connected to the parallel heat exchangers, which function as an evaporator, and performing control so that the value from the second pressure detector 95, which is the pressure of refrigerant at the branching portion, becomes a predetermined value.

Note that, also in the heating normal operation after the air-conditioning apparatus 102 performs the heating-defrosting operation, the total opening degree of the first flow control devices 7-1 to 7-4 may be controlled as described above and the opening degree of each of the first flow control devices 7-1 to 7-4 may be controlled in accordance with the frost states of the parallel heat exchangers 5-1 to 5-4 while satisfying the total opening degree.

The air-conditioning apparatus 102 of Embodiment 3 is provided with the injection pipe 38, which diverts a portion of refrigerant flowing from the second extension pipe 33-1 to the first flow control devices 7-1 to 7-4 and causes the portion of the refrigerant to flow into the compressor 1, and the second pressure detector 95, which detects the pressure of refrigerant at the branching portion, controls the total opening degree of the first flow control devices 4, which are connected to the parallel heat exchangers, which function as an evaporator, and control, while satisfying the total opening degree, each first flow control device in accordance with the frost state of the evaporator. The total opening degree corresponds to, for example, the total flow resistance obtained by totalizing all the flow resistances of the first flow control devices connected to parallel heat exchangers functioning as an evaporator. According to Embodiment 3, not only the heating capacity is increased by flow control performed in accordance with the frost states of the parallel heat exchangers but also the heating capacity can further be increased compared with Embodiment 1 by causing refrigerant to flow into the injection pipe at the predetermined flow rate and the degree of comfort in the indoor space can be increased.

Note that in Embodiments 1 to 3 described above, the case where the outdoor heat exchanger 5 is divided into the four parallel heat exchangers 5-1 to 5-4 has been described; however, the number of divisions is not limited to four. The outdoor heat exchanger 5 may also be configured such that two or more parallel heat exchangers are provided and there are two or more evaporators at the time of the heating normal operation, or three or more parallel heat exchangers are provided and there are two or more evaporators at the time of the heating-defrosting operation. Even with such a configuration, by applying Embodiments described above, one or more of the parallel heat exchangers are treated as targets to be defrosted and the other parallel heat exchangers are operated to continue the heating operation, and the degree of comfort in the indoor space can be increased.

In addition, the case where the air-conditioning apparatus 100 according to Embodiment 1, the air-conditioning apparatus 101 according to Embodiment 2, and the air-conditioning apparatus 102 according to Embodiment 3 are devices that perform switching between the cooling operation and the heating operation has been described as an example; however, air-conditioning apparatuses are not limited to these devices. Embodiments 1 to 3 described above can also be applied to air-conditioning apparatuses having a circuit configuration with which a cooling-heating simultaneous operation can be performed. In addition, in Embodiments 1 to 3 described above, the cooling-heating switching device 2 may be omitted and the air-conditioning apparatuses may perform only the heating normal operation and the heating-defrosting operation.

REFERENCE SIGNS LIST

1 compressor 2 cooling-heating switching device 3*b*, 3*c* load side heat exchanger 4*b*, 4*c* first pressure reducing device 5 outdoor heat exchanger 5-1 to 5-4 parallel heat exchanger 5*a* heat transfer tube 5*b*, 5*bn* fin 5*f* outdoor fan 6 accumulator 7-1 to 7-4 first flow control device 8-1 to 8-4 first open-close device 9-1 to 9-4 second open-close device 10 third pressure reducing device 11-1, 11-2 second flow control device 12-1 to 12-4 second pressure reducing device 13 fourth pressure reducing device 31 discharge pipe 32-1, 32-2*b*, 32-2*c* first extension pipe 33-1, 33-2*b*, 33-2*c* second extension pipe 34-1 to 34-4 first connection pipe 35-1 to 35-4 second connection pipe 36 suction pipe 37 bypass pipe 38 injection pipe 51*a* to 51*d* opening port 52 flow switching unit 90 controller 91 first pressure detector 92-1 to 92-4 temperature detector 93-1, 93-2 temperature detector 94 outside air temperature detector 95 second pressure detector 100, 101, 102 air-conditioning apparatus A outdoor unit B, C indoor unit.

The invention claimed is:

1. An air-conditioning apparatus comprising:

a main circuit in which a compressor, a load side heat exchanger, a first pressure reducer, and a plurality of parallel heat exchangers connected in parallel with each other are connected by pipes and through which refrigerant circulates;

a bypass pipe diverting a portion of refrigerant discharged by the compressor;

a third pressure reducer provided at the bypass pipe and reducing a pressure of refrigerant flowing into the bypass pipe;

a flow switcher connecting, from among the plurality of parallel heat exchangers, a parallel heat exchanger to be defrosted to the bypass pipe;

a plurality of flow rate control valves connected to the plurality of parallel heat exchangers and controlling flow rates of refrigerant flowing through the plurality of parallel heat exchangers; and a controller being configured to control the flow switcher and the plurality of flow rate control valves, the air-conditioning apparatus being configured to operate in a heating operation mode for causing the plurality of parallel heat exchangers to function as an evaporator, and a heating-defrosting operation mode for causing one or more of the plurality of parallel heat exchangers to function as a target to be defrosted and for causing an other parallel heat exchanger to function as an evaporator, wherein the number of the plurality of flow rate control valves is smaller than the number of the plurality of parallel heat exchangers, and at least one of the flow rate control valves is connected to two or more of the parallel heat exchangers, and the controller is configured to control in the heating-defrosting operation mode or in the heating operation mode after execution of the heating-defrosting operation mode, the flow rate control valves to control, in accordance with a frost state of the parallel heat exchanger functioning as an evaporator from among the plurality of parallel heat exchangers, the flow rate of refrigerant flowing through the parallel heat exchanger.

2. The air-conditioning apparatus of claim 1, wherein the controller is configured to control the flow rate control valves such that the smaller an amount of frost formed on the parallel heat exchanger functioning as the evaporator from among the plurality of parallel heat exchangers, the higher the flow rate of refrigerant flowing into the parallel heat exchanger functioning as the evaporator from among the plurality of parallel heat exchangers is.

3. The air-conditioning apparatus of claim 2, wherein the controller is configured to establish an order of defrosting to be performed among two or more of the parallel heat exchangers functioning as the evaporator according to relative magnitudes of frost on each of the parallel heat exchangers in the heating-defrosting operation mode, and regarding the flow rates of refrigerant flowing into the respective two or more parallel heat exchangers, control the flow rate control valves such that the more latter one of the two or more parallel heat exchangers is in the order of defrosting, the higher the flow rate of refrigerant is through the one of the two or more parallel heat exchangers.

4. The air-conditioning apparatus of claim 1, further comprising:

a detector for detecting a value for determining frost states of two or more parallel heat exchangers functioning as an evaporator from among the plurality of parallel heat exchangers, wherein, regarding the flow rates of refrigerant flowing into the two or more parallel heat exchangers, the controller controls, in accordance with the frost states determined using the value detected by the detector, the flow rate control valves such that the smaller an amount of frost formed, the higher the flow rate of refrigerant is.

5. The air-conditioning apparatus of claim 4, wherein the detector includes a first pressure detector for detecting a pressure of refrigerant of the parallel heat exchanger functioning as an evaporator from among the plurality of parallel heat exchangers, and a temperature detector for detecting a temperature of refrigerant downstream of the parallel heat exchanger functioning as an evaporator from among the plurality of parallel heat exchangers.

6. The air-conditioning apparatus of claim 5, wherein the controller is configured to determine the frost states using a degree of superheat of refrigerant calculated from a refrigerant saturation temperature calculated from the pressure of refrigerant detected by the first pressure detector and the temperature of refrigerant detected by the temperature detector, and determine that the lower the degree of superheat of refrigerant, the larger the amount of frost formed, and the higher the degree of superheat of refrigerant, the smaller the amount of frost formed.

7. The air-conditioning apparatus of claim 4, wherein when switching from the heating operation mode to the heating-defrosting operation mode is performed, the controller changes, in accordance with the frost state of the parallel heat exchanger functioning as an evaporator from among the plurality of parallel heat exchangers, a flow resistance of the flow rate control valves connected to the parallel heat exchanger.

8. The air-conditioning apparatus of claim 5, wherein in a case where the two or more of the parallel heat exchangers connected to the at least one of the flow rate control valves function as evaporators, the temperature detector, which is a single temperature detector, is installed downstream of the two or more of the parallel heat exchangers and at a position for detecting temperatures of refrigerant of the two or more of the parallel heat exchangers.

9. The air-conditioning apparatus of claim 1, further comprising: a second pressure reducer reducing, in a case one or both of the two or more of the parallel heat exchangers connected to the at least one of the flow rate control valves are selected to be defrosted, a pressure of refrigerant flowing out from the parallel heat exchanger or exchangers to be defrosted, the second pressure reducer being provided downstream of the two or more of the parallel heat exchangers.

10. The air-conditioning apparatus of claim 1, wherein the controller is configured to calculate a heating load in a case where the load side heat exchanger functions as a condenser, and change, in accordance with the heating load, a number of parallel heat exchangers to be defrosted from among the plurality of parallel heat exchangers in the heating-defrosting operation mode.

11. The air-conditioning apparatus of claim 1, further comprising:

an outside air temperature detector for detecting outside air temperature, wherein the controller is configured to change, in accordance with the outside air temperature, a number of parallel heat exchangers to be defrosted from among the plurality of parallel heat exchangers in the heating-defrosting operation mode.

12. The air-conditioning apparatus of claim 1, comprising:

an injection pipe diverting a portion of refrigerant flowing from the first pressure reducer to the flow rate control valves and causing the portion of refrigerant to flow into the compressor;

a fourth pressure reducer provided at the injection pipe; and a second pressure detector for detecting a pressure of refrigerant at a branching portion of the injection pipe, wherein the controller is configured to determine, in the heating-defrosting operation mode or in the heating operation mode after execution of the heating-defrosting operation mode, a total flow resistance obtained by totalizing all flow resistances of the flow rate control valves connected to parallel heat exchangers functioning as an evaporator from among the plurality of parallel heat exchangers so that the pressure detected by the second pressure detector is a predetermined value, and controls, while satisfying the determined total flow resistance, each of the flow rate control valves to control the flow rates of refrigerant flowing through the parallel heat exchangers in accordance with frost states of the parallel heat exchangers.

* * * * *